US006758826B2

(12) United States Patent
Luettgen et al.

(10) Patent No.: US 6,758,826 B2
(45) Date of Patent: Jul. 6, 2004

(54) VIBRATING PERSONAL MASSAGER

(75) Inventors: Harold A. Luettgen, Windsor, CO (US); Gary D. Golichowski, Cheyenne, WY (US)

(73) Assignee: Water Pik, Inc., Fort Collins, CO (US)

( * ) Notice: Subject to any disclaimer, the term of this patent is extended or adjusted under 35 U.S.C. 154(b) by 0 days.

(21) Appl. No.: 10/142,278

(22) Filed: May 8, 2002

(65) Prior Publication Data

US 2003/0009116 A1 Jan. 9, 2003

Related U.S. Application Data

(60) Provisional application No. 60/303,025, filed on Jul. 3, 2001.

(51) Int. Cl.[7] ..... A61H 7/00

(52) U.S. Cl. ..... 601/73; 601/72; 601/135; 601/137

(58) Field of Search ..... 601/46, 70, 72–73, 601/80, 119, 134, 135, 137, 138, 125; D24/214, 215

(56) References Cited

U.S. PATENT DOCUMENTS

| | | | | | |
|---|---|---|---|---|---|
| 3,856,002 | A | * | 12/1974 | Matsumoto | 601/137 |
| 4,002,164 | A | * | 1/1977 | Bradley | 601/135 |
| 4,266,536 | A | * | 5/1981 | Casares | 601/119 |
| 4,632,095 | A | * | 12/1986 | Libin | 601/135 |
| D317,204 | S | | 5/1991 | Henneseey | D24/211 |
| 5,193,528 | A | * | 3/1993 | Iwamoto et al. | 601/72 |
| D377,100 | S | | 12/1996 | Gladieux, Jr. | D24/211 |
| 5,673,455 | A | * | 10/1997 | Per-Lee et al. | 601/137 |
| D387,174 | S | | 12/1997 | Gladieux, Jr. | D24/214 |
| D402,764 | S | * | 12/1998 | Chatfield | D24/211 |
| D403,431 | S | | 12/1998 | Gladieux, Jr. | D24/215 |
| 5,848,980 | A | * | 12/1998 | Demerais | 601/46 |
| D423,676 | S | | 4/2000 | Lazio | D24/214 |
| D436,181 | S | | 1/2001 | Lazio | D24/214 |
| D444,566 | S | | 7/2001 | Thomas et al. | D24/214 |
| 6,261,251 | B1 | * | 7/2001 | Meyers | 601/135 |

OTHER PUBLICATIONS

"The Original Backnobber II Tool," Bernard L. Gladieux, Jr., The Pressure Positive Co., Gilbertsville, PA, (1999), pp. 1–36.

"Thera Cane for Deep Pressure Massage Owners Manual," Dan Hennessey, Thera Cane Co., Denver, CO (1980, reprinted 2000).

* cited by examiner

*Primary Examiner*—Danton D. DeMille
*Assistant Examiner*—Quang D. Thanh
(74) *Attorney, Agent, or Firm*—Dorsey & Whitney LLP

(57) ABSTRACT

A J-shaped vibrating massager and method for manufacture thereof. The J-shaped massager may consist of a J-shaped tubular rod, a head, one or more handles, vibratory sources, and vibratory controls. Generally, the J-shaped tubular rod may also consist of a J-hook and a barrel. Typically, the head is located at the end of the J-hook opposite the barrel, while the vibratory source may be mounted in the head or anywhere along the length of the J-shaped tubular rod. The vibratory source induces vibrations in one or more portions of the J-shaped tubular rod, generally including the head. The vibrations massage surfaces in contact with the invention. Because the invention is generally J-shaped, a user may reach his or her own back with the head of the J-shaped massager in order to give himself a back massage. The invention may include a variety of tips having different sizes, materials, and shapes.

27 Claims, 21 Drawing Sheets

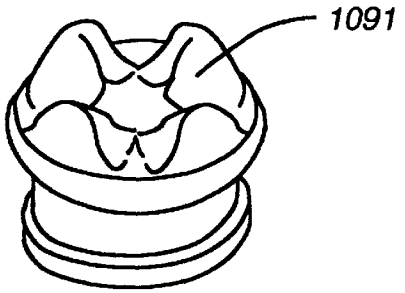
Fig. 10R
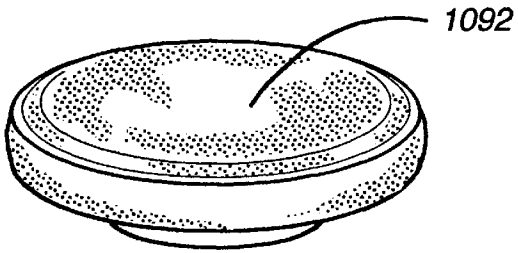
Fig. 10S
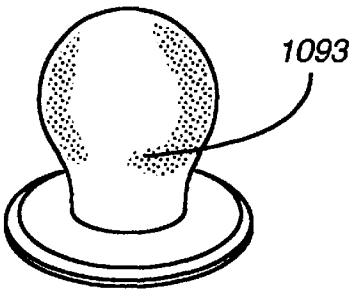
Fig. 10T
Fig. 10U
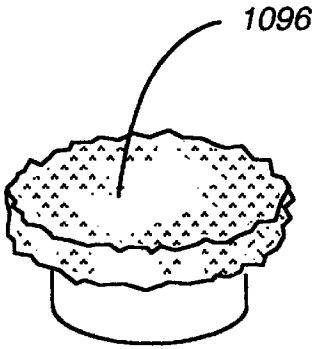
Fig. 10V

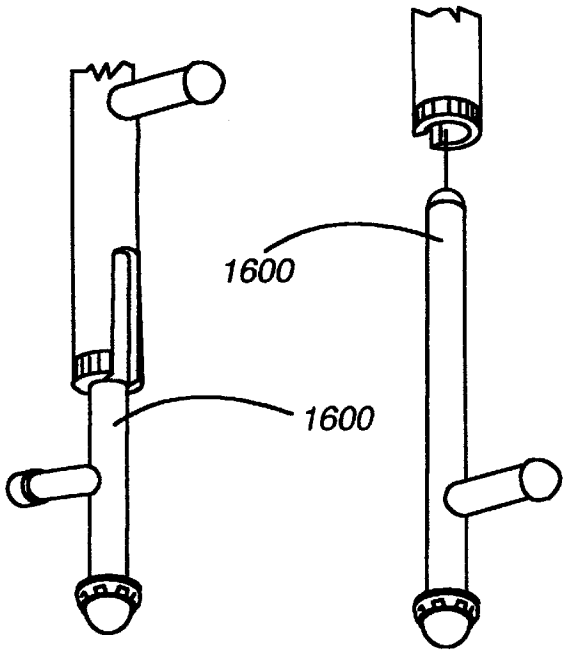
Fig. 17D
Fig. 17C
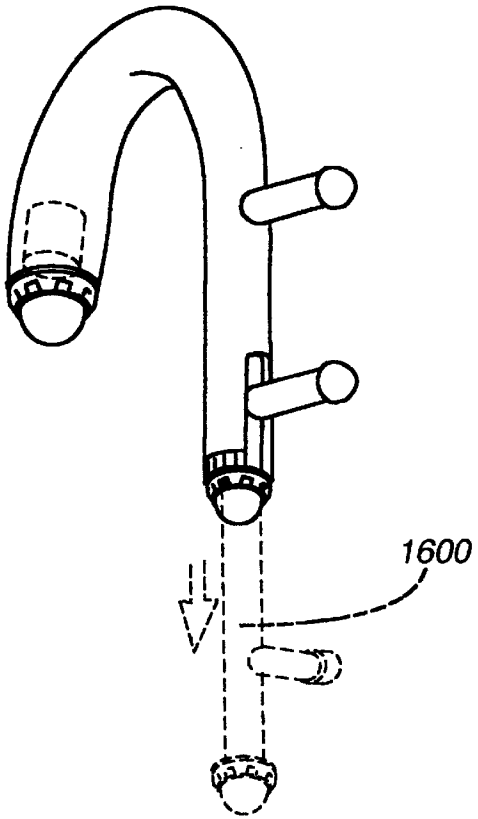
Fig. 17B
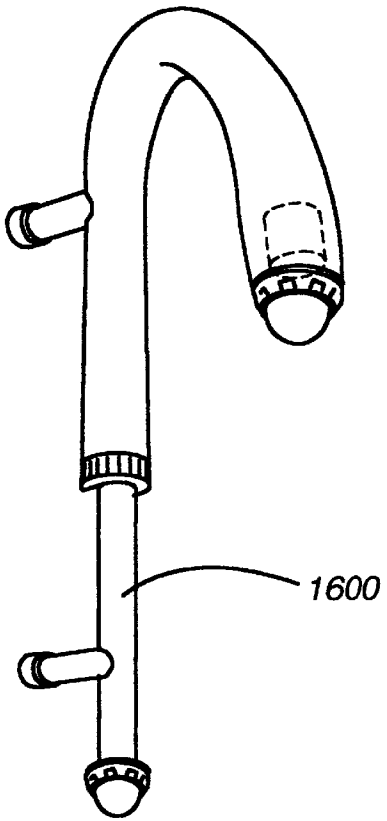
Fig. 17A

VIBRATING PERSONAL MASSAGER

CROSS-REFERENCE TO RELATED APPLICATION

This application claims priority to provisional patent application No. 60/303,025, entitled "VIBRATING PERSONAL MASSAGER" and filed Jul. 3, 2001, which is hereby incorporated by reference in its entirety as if fully disclosed herein.

FIELD OF THE INVENTION

The present invention generally relates to hand-held massagers. More specifically, the present invention relates to hand-held massagers including at least one portion with vibratory means configured to allow a user grasping the massager with their hands to contact substantially all the surfaces of their body including the entire surface of their back.

BACKGROUND OF THE INVENTION

Massage has been used for many years to soothe or eliminate muscle and joint pains, or simply to relax and refresh a person. Fairly recently, personal massage devices have been introduced to the marketplace to impart to otherwise unskilled persons the ability to give and receive a comforting massage. The vast majority of these massage devices are relatively short, often a foot in length or less. Generally, such devices are relatively linear, with one end serving as a massage head and the other as a handle or gripping surface. Because of the overall length and shape of current personal massage devices, it is extremely difficult for a user to massage his or her own back. Rather, a user may only massage a second person with any degree of success. This greatly limits the utility of most personal massage devices.

Accordingly, there is a need in the art for an improved personal massage device.

SUMMARY OF THE INVENTION

The invention generally takes the form of a J-shaped massager having at least one vibratory means for inducing rapid movement in a portion of the massager. The J-shaped massager may consist of a J-shaped tubular rod, a head, and vibratory means. Generally, the J-shaped tubular rod is further subdivided into a J-hook and a barrel. The J-hook and barrel may be two separate elements, or may simply refer to two portions of a contiguous rod. Typically, the head is located at the end of the J-hook opposite the barrel while the vibratory means may be mounted in the head or anywhere along the length of the J-shaped tubular rod.

Further, the J-shaped massager may include one or more handles for grasping and manipulating the massager, a control means for activating and deactivating the vibratory means, a connection means located on the end of the head, and one or more tips capable of mating with the connection means. The tips may include a quick-release securing mechanism for mating with the connection means.

When operating, the vibratory means induces vibrations in one or more portions of the J-shaped tubular rod. Vibrational force increases as the distance to the motor decreases. Accordingly, the head generally experiences the greatest vibrational force. When the head, a mounted tip, or any other vibrating portion of the massager is pressed against skin, the rapid oscillation caused by the vibrations induces a soothing massage in the skin. Because the invention is generally J-shaped, a user may comfortably reach his or her own back with the head of the J-shaped massager in order to give him- or herself a back massage. A user may apply appropriate force to the tip attached to the head of the J-shaped massager while the tip is pressed against a user's back or skin. Because the head of the J-shaped massager may reach substantially any portion of the user's body without requiring contortions or twisting by the user, the muscles of the area massaged remain relaxed and receive greater benefit from the massaging action.

The tips may come in a variety of sizes, materials, and shapes. Tips may include heating means or may be heatable, may induce different types of massage due to differing surface areas, and may be capable of full or partial movement. For example, one tip may take the form of a wheel or disc capable of rolling back and forth over skin, while another may be filled with a gel capable of maintaining heat for an extended period.

Accordingly, the present invention generally takes the form of a J-shaped vibrating massager having at least one handle, a barrel, a J-shaped hook, a head, and one or more tips, and permitting a user to massage substantially all surfaces of his or her body without contortion, including the back. The J-shaped massager further includes at least one vibratory means for inducing vibrations in at least the head of the massager, which induces the massaging action of the present invention. The J-shaped vibrating massager typically has multiple tips that may be quickly and easily attached to any of the ends of the massager in order to vary the pressure, area, or other characteristics of the massage at that tip location. These tip locations may also act as storage areas for a tip. Each tip location may apply massaging force to areas of the body through the attached tip.

BRIEF DESCRIPTION OF THE DRAWINGS

FIGS. 17A–17D display a portable embodiment of the present invention.

DETAILED DESCRIPTION OF THE INVENTION

Introduction

Generally, the present invention comprises a method and apparatus for manufacturing and using a J-shaped vibrating personal massager. The massager is generally shaped like the letter "J" and includes a vibratory means capable of inducing vibrations in at least one portion of the massager. In the present embodiment, the vibratory means vibrates in the head located at one end of the J-shaped vibrating massager. A user may grasp the J-shaped vibrating massager and, while maintaining a forward facing, firmly apply pressure to his or her back via the head or a tip mounted thereto. If the J-shaped vibrating massager is active and the vibratory means induces vibrations in the head, this results in a firm yet soothing massage to the back or other areas of the body. The vibratory force may also be transmitted to tips, stubs, or other elements located along the length of the J-shaped massager. Thus, multiple portions of the J-shaped massager may be used to massage a user's body.

Physical Configuration of the J-Shaped Vibrating Massager

Figure 1:
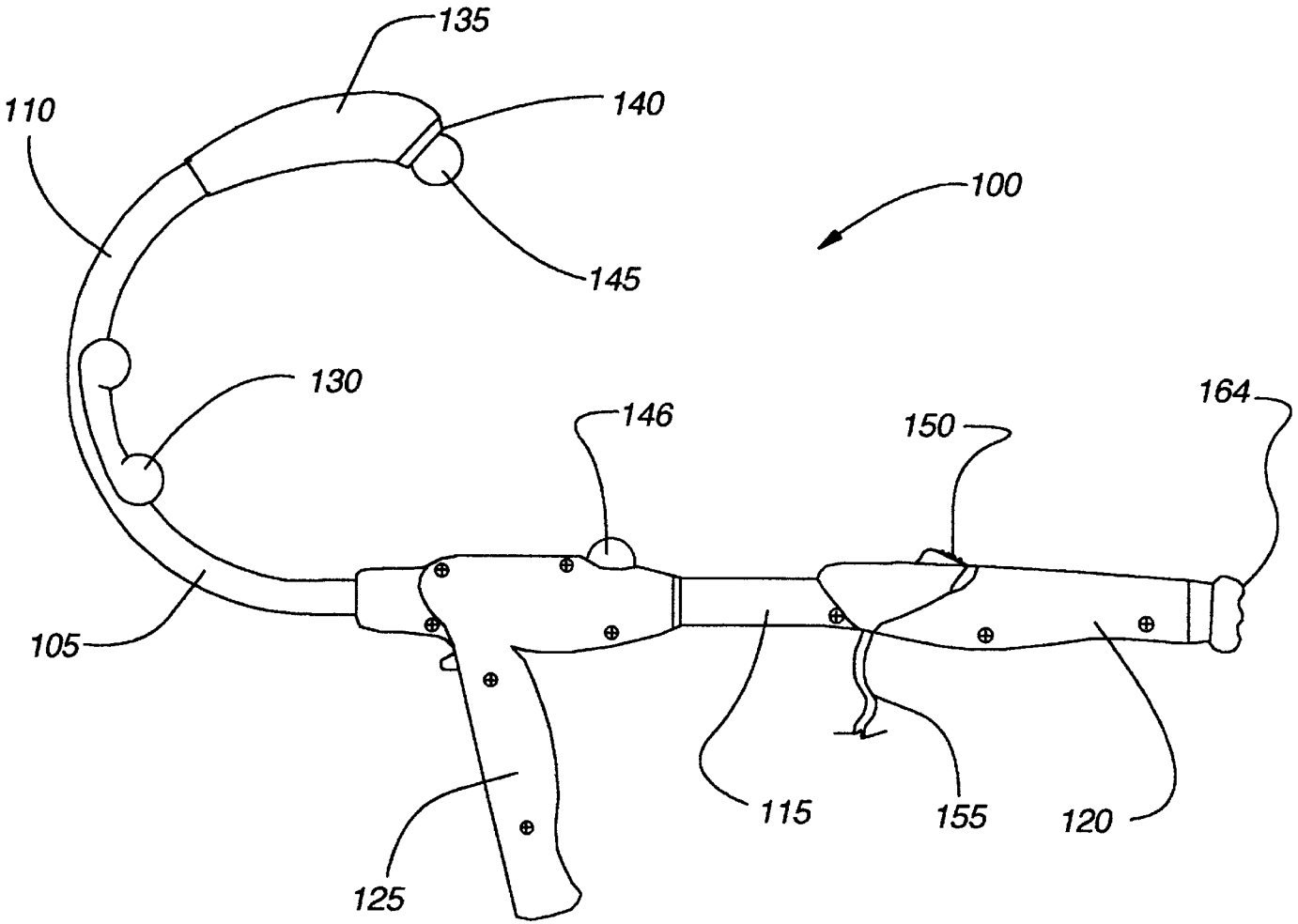
FIG. 1 displays an embodiment of the present invention.

FIG. 1 illustrates an embodiment of the present invention. The J-shaped massager 100 has a generally J-shaped configuration consisting of a substantially straight portion (the "barrel" 115) and a generally curved portion (the "J-hook" 110) attached to the end of the barrel. The overall shape, therefore, is similar to the letter "J." A head 135 at one end of the J-hook 110 may be fitted with a variety of tips 145 and may vibrate rapidly when activated. Similarly, massaging points may be located at a stub 130, a tip holding structure 160, and an intermediate nub 146. Any or all of these elements may be used as a massage surface, and the intermediate nub 146 may removably accept a tip 145. The combination of various tips and the vibrating motion, when placed against a portion of the body, massages tissue. Different tips 145 may provide different types of massage, and some tips may be heated. The J-shaped massager 100 includes at least one handle 120 to allow a user to grasp the massager. Generally, this handle is located at the end of the barrel 115 opposite the J-hook 110. A second handle 125 may be located partway along the barrel 115 and extend outwardly therefrom at an acute angle. The second handle 125 may be rotatable about the barrel 115 of the J-shaped massager 100.

It should be noted that the barrel 115 and J-hook 110 may be an integral piece, or may be two separate pieces connected to one another in any manner known to those skilled in the art. As previously stated, two handle portions 120, 125 may extend from the barrel 115 of the J-shaped rod and away from the J-hook 110. In other embodiments the opposite may be true, no handles may be present, or a different number of handles (such as one or three) may be present. The handles and are used to manipulate the J-shaped rod.

Generally, the J-shaped tubular rod 105 is a hollow rod of approximately 0.75 inches in diameter, and made from a metal such as aluminum or steel. Alternate embodiments may use different materials to manufacture the rod, such as a plastic or ceramic, and may have different diameter rods. Further, alternate embodiments may use a solid tubular rod 105 made of a substance such as glass filled nylon. The J-shaped tubular rod 105 may include one or more stubs 130 located along its length. These stubs provide additional massaging surfaces when brought into contact with a user. In the present embodiment, two stubs are attached approximately midway along the inside curve of the J-hook 110. "Inside curve" refers to the exterior portion of the J-hook 110 located within the curve defining the hook.

Figure 4:
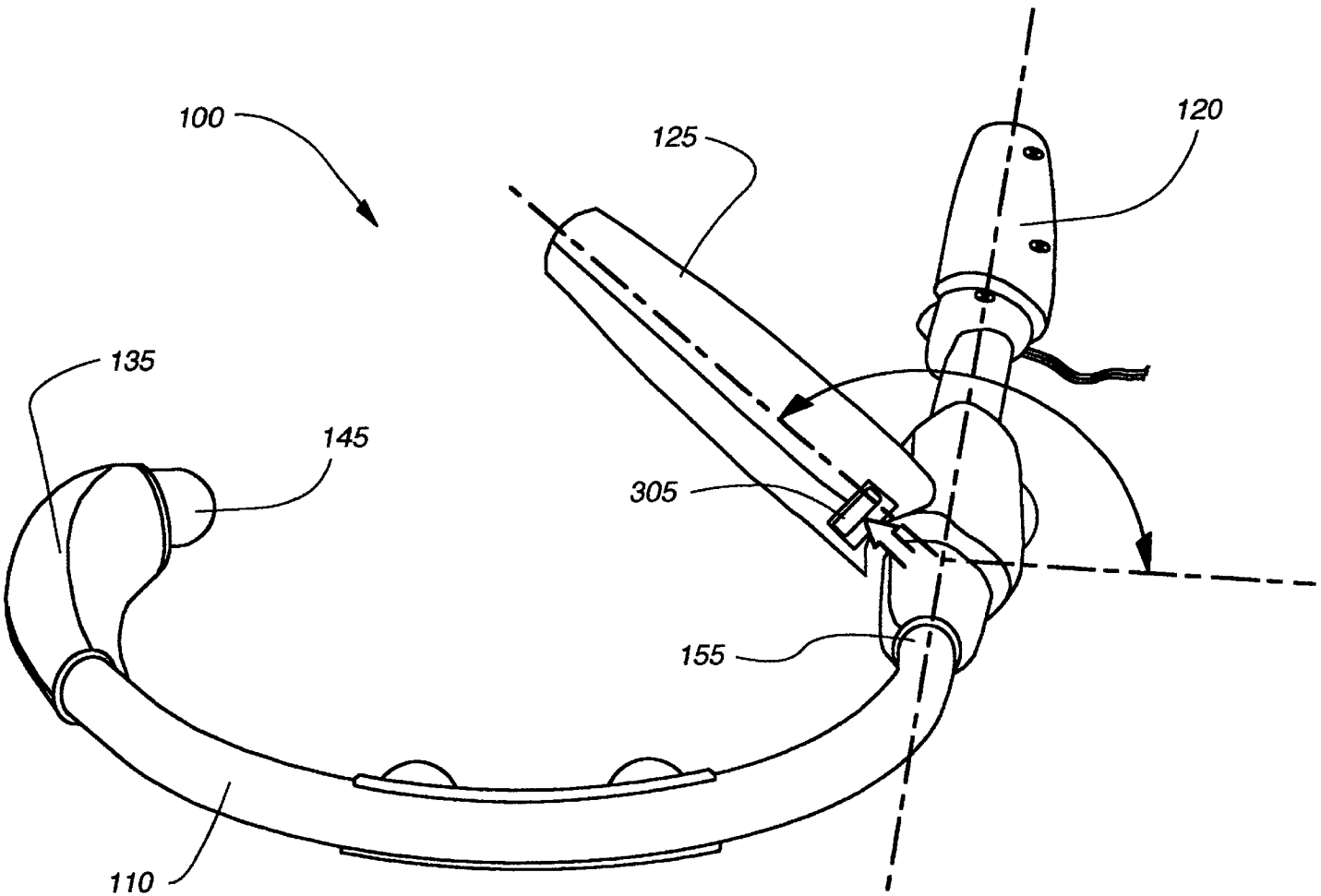
FIG. 4 displays the second handle of FIG. 3A in a rotated and locked position.
Figure 5:
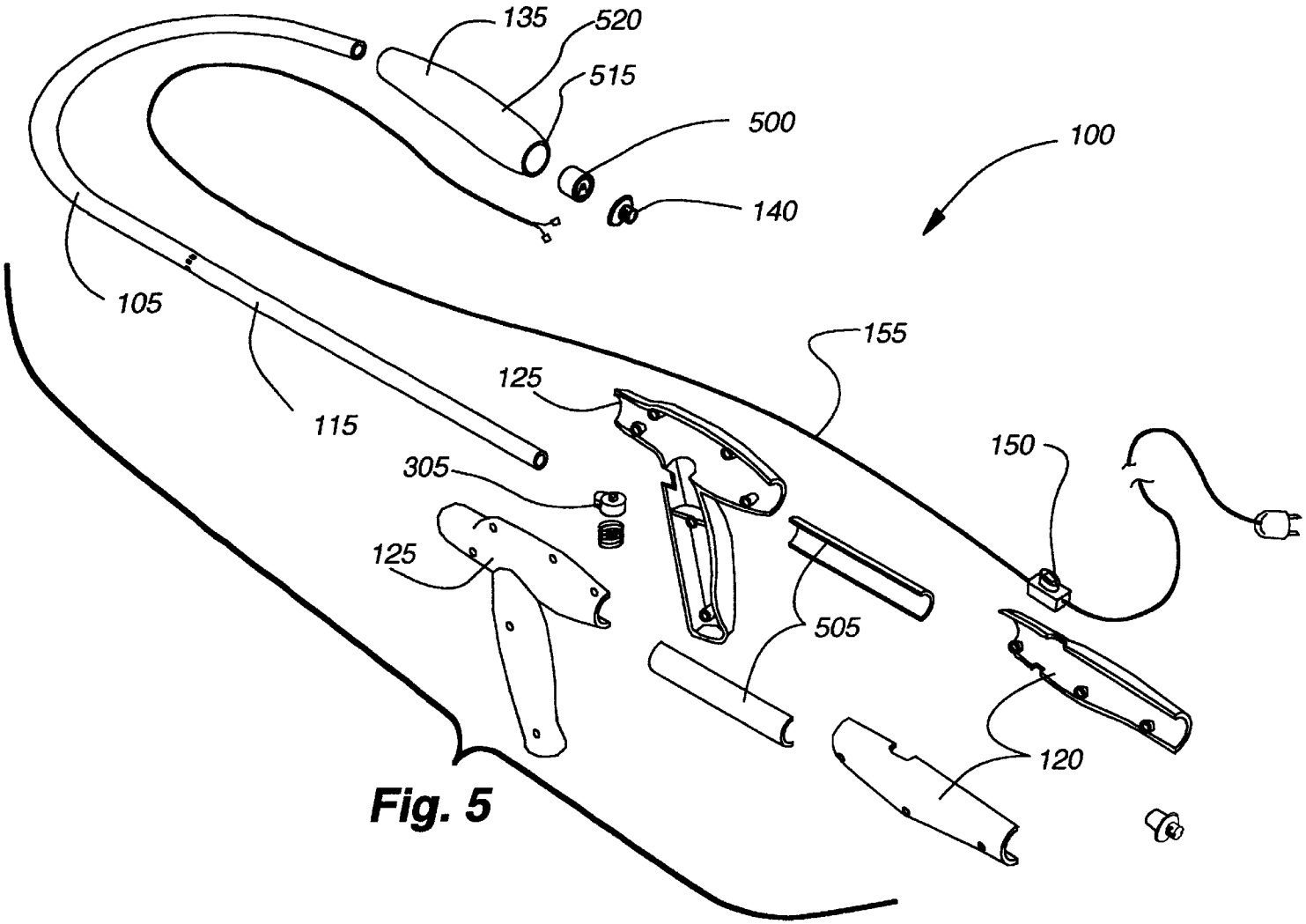
FIG. 5 displays an exploded view of the embodiment shown in FIG. 1.

The J-hook 110 has a radius of approximately six inches with one end terminating in a head 135. The head 135 is generally molded from plastic, although again alternate embodiments may use different materials. The head, like the J-hook, is also curved. However, in the present embodiment the curvature of the head 135 is less than that of the J-hook 110. This may differ in different embodiments. At the end of the head 135 mating with the J-hook 110, the diameter of the head is approximately that of the J-hook. Along the length of the head 135, its cross-sectional shape changes from circular to elliptical, while its size gradually increases to a diameter of approximately 1.75 inches along the long axis of the ellipse. This is best shown in FIGS. 4 and 5, and discussed further with respect to those drawings.

The head 135 terminates in a connectable end 140 (located in FIG. 1 beneath the removable tip 145) which may accept a variety of tips. These tips 145 may be releasably connected to the connectable end 140 via a quick-release securing mechanism. This mechanism is described in more detail with respect to FIG. 8, below.

Figure 2:
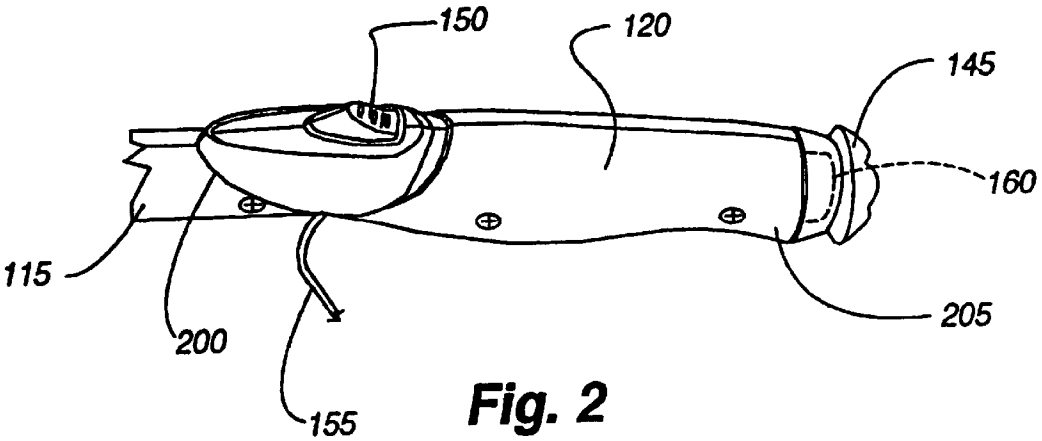
FIG. 2 displays a view of a first handle for gripping the invention.

FIG. 2 displays a view of a first handle 120 for gripping the invention. In the present embodiment, the first handle 120 projects substantially parallel to and in line with the barrel 115 of the J-shaped vibrating massager 100. The first handle 120 may be formed from one or more pieces of molded plastic which assemble to form the handle. These pieces may be fastened together by a variety of means, such as screws, adhesive, heat treatment, and so forth. The first handle 120 has a front end 200, where the handle joins the barrel 115 of the J-shaped vibrating massager 100, and a rear end 205, where the handle terminates. It should be noted that the handle may extend forward, partially covering the barrel 115.

In the present embodiment, the first handle 120 is ergonomically contoured to enhance a user's grip. The bottom of the first handle 120 is mildly S-curved, having a slight convex curve at the front end 200 and a slight concave curve at the rear end 205. In the present embodiment, the transition point between the convex and concave curves is located slightly closer to the rear end than the front end, although this may vary in alternate embodiments. The rear end 205 of the first handle 120 terminates in a tip holding structure 160, on which a tip 145 may be kept. The tip holding structure may be used as a massage point. The tip holding structure 160 of the present embodiment takes the form of a bayonet or post and channel arrangement, as described more specifically with respect to FIGS. 8–9, below.

The first handle 120 additionally may include a control means 150 mounted thereto. Generally, the control means 150 is mounted on the top surface of the first handle 120, near the front end 200. The control means 150 may include a power switch or a rheostat control, which may take the form of a slide switch, as shown, a rocker switch, or other control means known to those skilled in the art. Such means include, for example, a touch-sensitive switch, a button, a slider control, and so forth. Generally, the power switch activates and deactivates the vibratory means, which is further discussed below. A rheostat generally controls the speed and intensity of the vibratory means' operation. The control means 150 and rheostat may be mounted on alternate portions of the J-shaped massager, such as along the length of the power cord 155, on the second handle 125, and so forth. Further, alternate embodiments may eliminate the control means 150 and/or rheostat entirely, instead activating the vibratory means by simply plugging the power cord 155 into a wall outlet.

In the present embodiment, the first handle 120 also includes a power cord 155 connected within the J-shaped vibrating massager's interior to the control means 150. The power cord 155 then extends outwardly from the massager 100 interior through a side of the first handle 120. Alternate embodiments may permit the power cord 155 to exit through other portions of the J-shaped vibrating massager 100, such as at the rear end 205 of the first handle 120, through the barrel 115, through a second handle 125, and so forth. Generally, the power cord 155 may be plugged into any standard home power source to provide power to the massager 100.

Figure 3A:
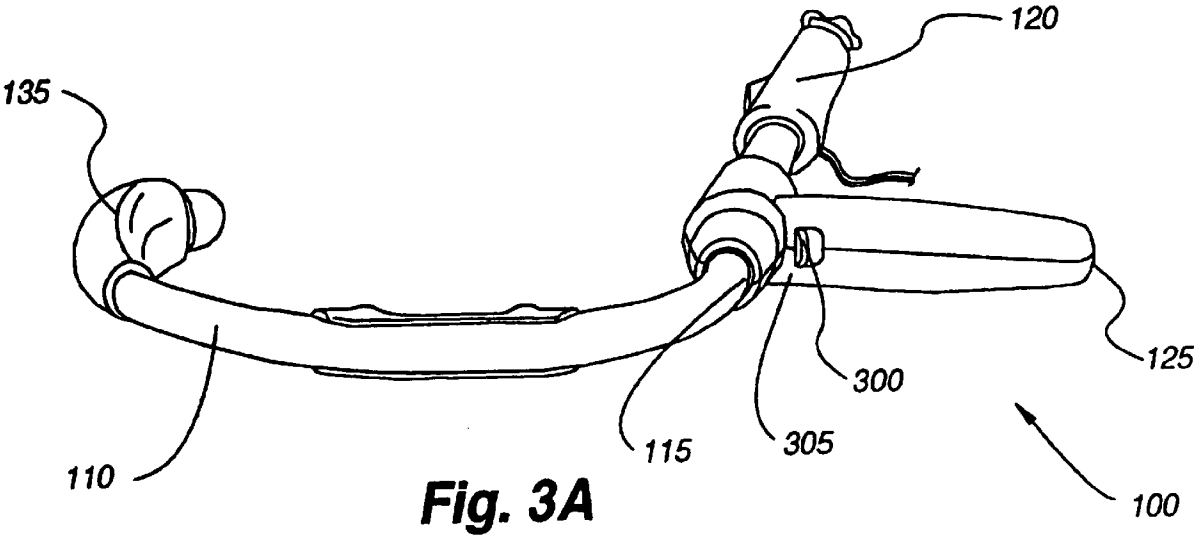
FIG. 3A displays a side view of a second handle in accordance with an embodiment of the present invention.

FIGS. 1 and 3A display a side view of a second handle 125 in accordance with the present embodiment of the invention. The second handle 125 generally attaches to the barrel 115 of the J-shaped vibrating massager 100 at an acute angle. In the present embodiment, this angle is approximately seventy-five degrees from the center of the barrel 115, with the second handle 125 tilted towards the first handle 120. Alternate embodiments may attach the second handle 125 to the barrel 115 at a different angle, may omit the second handle, or may attach the second handle to a different part of the J-shaped vibrating massager 100, such as the first handle 120 or J-hook 110.

As with the first handle 120, the second handle 125 is generally formed from two pieces of molded plastic designed to mate in order to form the handle surface. The pieces of the second handle 125 may be connected to one another via any means known to those skilled in the art, although the present embodiment uses screws.

The second handle 125 is also ergonomically shaped, being generally convex along the body of the handle. The second handle 125 generally provides an additional gripping surface to facilitate manipulating the J-shaped vibrating massager 100. In the present embodiment, the second handle 125 may further be rotated freely about the barrel 115.

Figure 3B:
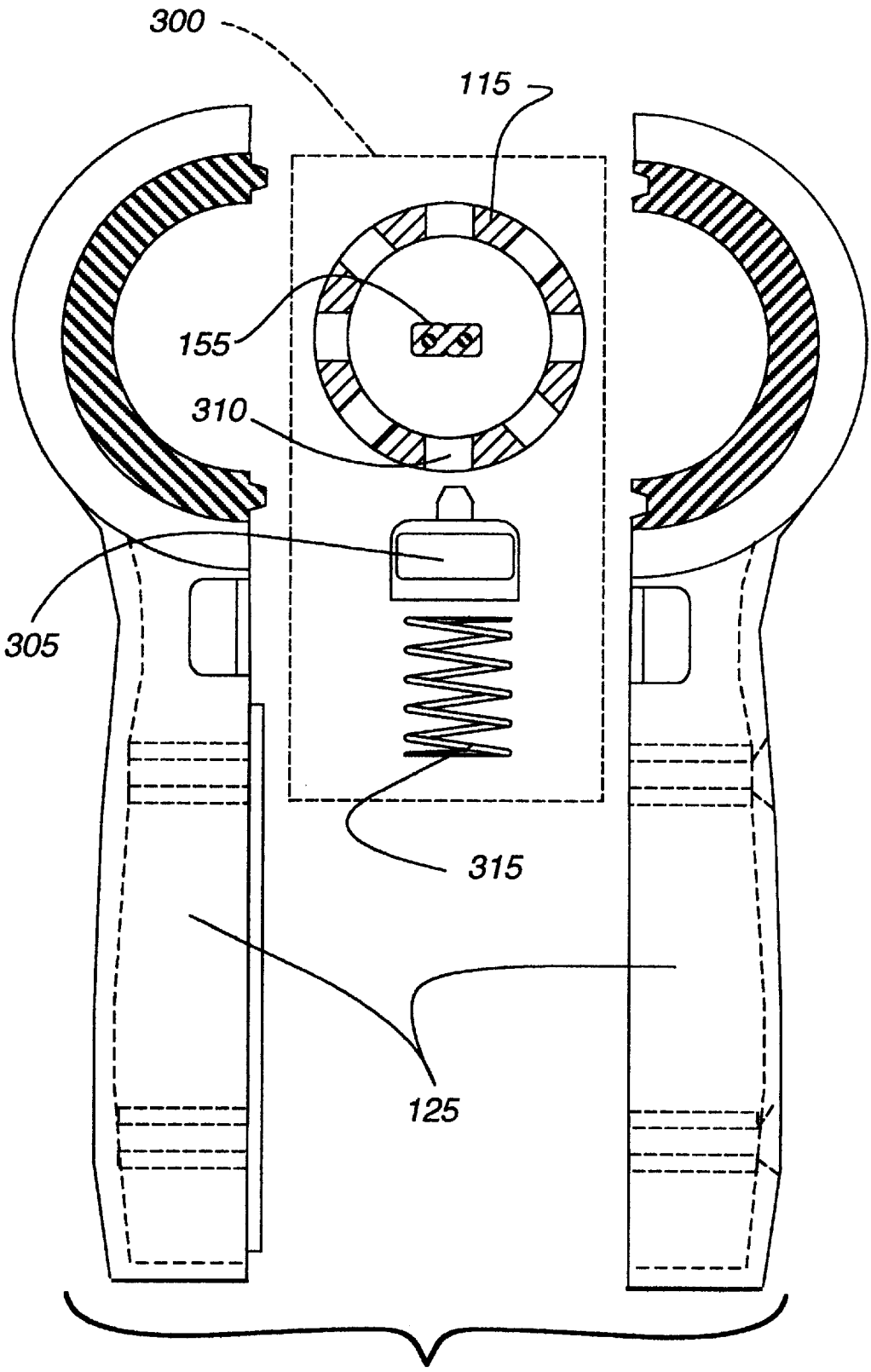
FIG. 3B displays a cross-sectional exploded view of a handle release mechanism in accordance with an embodiment of the present invention.

In order to rotate the second handle 125, a handle release mechanism 300 is employed. A cross-sectional exploded view of the second handle 125 and such a mechanism is shown in FIG. 3B. First, a handle release switch 305 is depressed and held down against the force of a spring. While the handle release switch 305 is held, a user may freely turn the second handle 125 until a suitable position is achieved, at which point the handle release 300 is freed. A series of slots 310 are present on the surface of the barrel 115 beneath the second handle 125. As the handle release 300 is let go, a spring 315 forces the release 300 upward. This forces a lock into one of the slots, or up against the barrel 115 surface until the second handle 125 is turned sufficiently to allow the lock to mate with a slot. Once in place, the lock is held in a slot by the pressure of the spring. Alternately, a detent may prevent the lock from moving further. The spring and lock are both concealed by the exterior of the second handle 125 when the J-shaped vibrating massager 100 is fully assembled. Alternate embodiments may omit this rotating feature, or may implement alternate method of permitting rotation and locking, such as a channel and T-shaped lock arrangement, with the head 135 of the "T" fitting into grooves extending outward from the channel center.

Figure 3C:
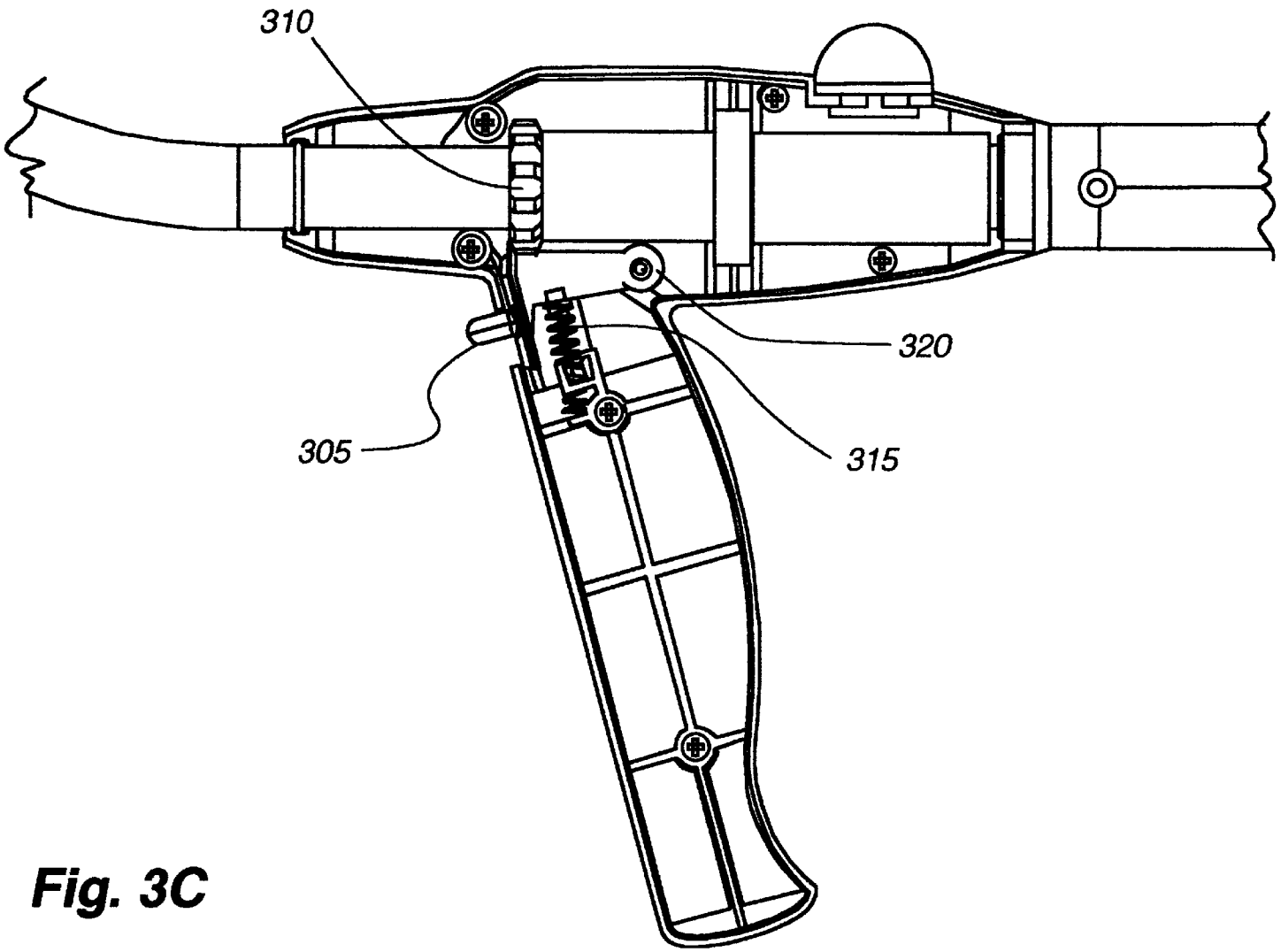
FIG. 3C displays a cross-sectional view of the handle release mechanism of FIG. 3B in an assembled position.

FIG. 3C displays a second cross-sectional view of the handle release mechanism located within the second handle, this time taken parallel to the length of the barrel 115. The cross-section of FIG. 3C shows the handle release 300 in an assembled state. The handle release switch 305 extends outward from the second handle 125 housing, and is connected to and rotates about a pivot point 320. The spring 315 rests beneath the handle release switch, forcing the lock atop the switch 305 into a slot 310.

FIG. 4 displays the second handle 125 in a rotated and locked position relative to FIG. 3A.

The first 120 and second 125 handles may additionally be covered with exteriors such as a foam shell, strap, winding, rubber housing and so forth to enhance their gripping surfaces as well as provide additional security when handling the J-shaped vibrating massager 100. These exteriors may removably encase the handles, or may be more permanently attached via any means known to those skilled in the art. Such means of attachment may include adhesive, heat treatments, screws, clips, and so forth. Alternately, in the case of a winding or strap covering, the ends may be tied to secure the covering to the handle.

Manufacture of the J-Shaped Vibrating Massager

FIG. 5 illustrates an exploded view of the embodiment illustrated in FIGS. 1–4. Dashed boxes indicate the pieces that make up each element of the present embodiment. Dashed arrows indicate the approximate placement of each element in the J-shaped tubular rod 105 or with respect to one another.

As illustrated in FIG. 5, fabrication of one embodiment of the present invention includes the combination of seven major components, each of which corresponds to a fabrication step. The following fabrication steps, however, do not indicate an order of manufacture, but may instead be executed as necessary. First, a J-shaped tubular rod 105 is provided. Second, a head 135 formed of a top 515 and bottom 520 housing is shown. Third, vibratory means 500 are placed within the bottom housing 520 of the head 135 and secured via straps 525, ties, or other means known to those skilled in the art. Fourth, a power cord 155 including a control means 150 is attached to the eccentric motor and run along the length of the rod through its interior. In the exemplary embodiment, the control means 150 is positioned along the surface of the first handle 120, as shown. Fifth, a first handle 120 is mounted to the barrel 115 of the J-shaped tubular rod 105. Sixth, a second handle 125 is also mounted to the barrel 115. It should be noted that these handles may be formed from a single piece, or one or more pieces may fit together to form each handle (as shown).

Optionally, a padded cover may be then fitted around the rod. Finally, an exterior 505 may be wrapped or placed around exposed portions of the J-shaped tubular rod 105 and/or handles. For example, the exterior 505 may comprise a foam cover fitting over one or both handles, or may envelop the tubular rod 105 from one end of the rod to the other end as well as the handles. The exterior 505 is secured as previously mentioned at the end of the section entitled, "Physical Configuration of the J-Shaped Vibrating Massager 100." Of course, the padded cover or exterior could also be co-molded to the J-shaped rod, or affixed to the rod in some other way.

It should be noted that some embodiments of the present invention may eliminate one or more of these steps. For example, an alternate embodiment of the invention may exclude the padded cover 510 or exterior 505. Further, alternate embodiments may add additional steps or configure such steps differently. As an additional example, an alternate embodiment may run the power cord 155 along the length of the J-shaped tubular rod 105 and across the rod's exterior, rather than through the interior. This embodiment may add an additional fabrication step, such as covering the rod 105 and cord 155 with a padded or insulating cover 510. As yet another example, the vibratory means 500 may be attached to a portion of the J-shaped tubular rod 105, rather than placed in the bottom housing of the head 135. As a final example, the control means 150 may be molded into a handle and the power cord 155 attached thereto.

Figure 6:
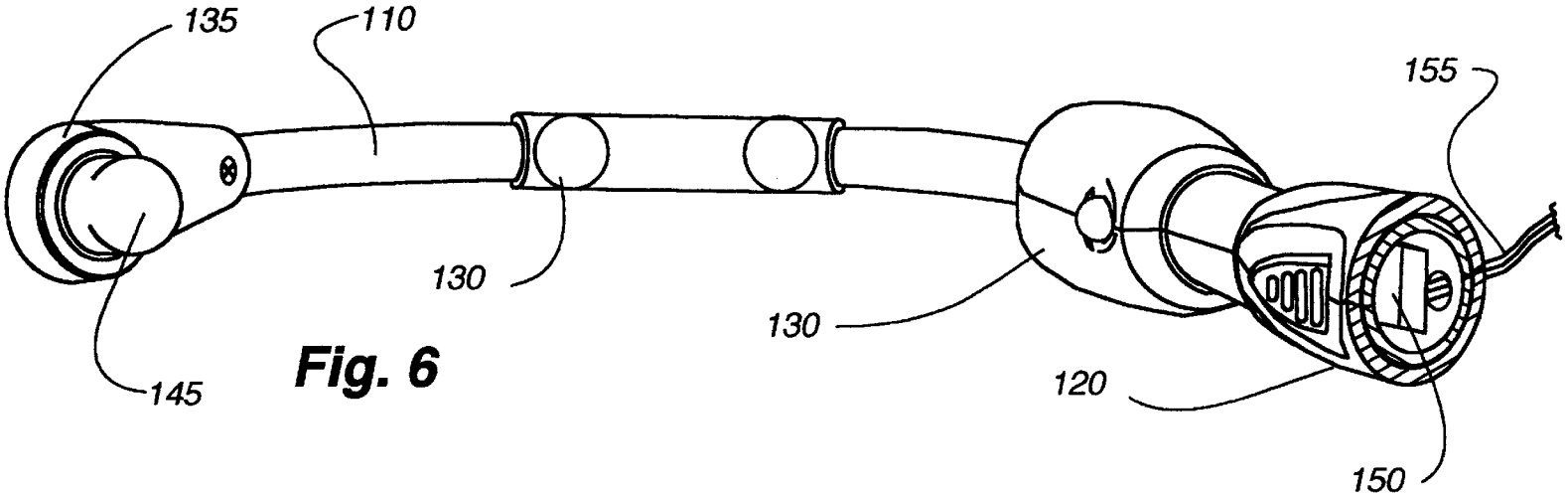
FIG. 6 displays a set of stubs attached to the J-hook portion of the embodiment shown in FIG. 1.

Additionally, other steps that are not critical to the operation of the base invention have been omitted from the above description. For example, manufacture of the present embodiment also includes the step of mounting one or more stubs 130 to the J-hook 110. Such stubs are shown prominently in FIG. 6.

Returning to FIG. 5, the J-shaped body 105 is generally rigid so that the vibration can be transmitted from the head 135 to other portions of the J-hook 110 as desired. Other materials of construction are contemplated for use in the present invention. It is contemplated that virtually any material may be used providing it properly permits the vibrations of the vibratory means 500 to move the head 135 and associated tips 145 as necessary, and permits other portions of the J-hook 110 (such as the intermediate nub 146) to vibrate as desired. In the present embodiment, the diameter of the tubular rod 105 comprising the base of the J-hook 110 and barrel 115 is about three-quarters of an inch. Further, the radius of the J-hook 110 portion is about six inches, and the overall length is about twenty-six inches. The stubs in the present embodiment are approximately one and three-quarters inches in diameter and two inches apart. Similarly, the handles in the present embodiment have a diameter of roughly one and three-quarters inches. Alternate embodiments may vary any or all of these measurements.

Massager Head and Removable Tip Structure

Figure 7:
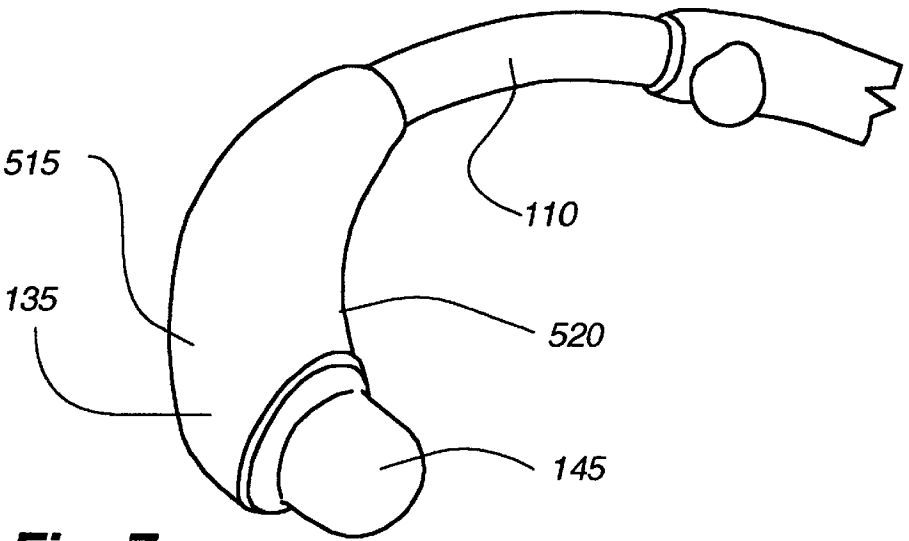
FIG. 7 displays the head and end structure of the embodiment of FIG. 1.

FIG. 7 displays the J-shaped vibrating massager's head 135 along with an attached tip 145. The head 135 diameter is approximately one and three-quarters inches in the present embodiment, while the change in diameter from the end of the head 135 to the 800 means is generally one inch. The head 135 is typically constructed from a top housing 515 and a bottom housing 520, which fit together and are attached to one another. A cavity is formed within the head 135 for receiving the end portion of the J-hook 110. Further, the cavity houses a vibratory means 500. The vibratory means 500 is further discussed below.

As previously explained, a tip 145 may be easily fitted or removed to the head 135 via a connection means 140. The tip 145 serves to transfer the vibrations of the J-shaped vibrating massager 100 from the head 135 and J-hook 110 to the user, thus providing a massage.

Figure 8C:
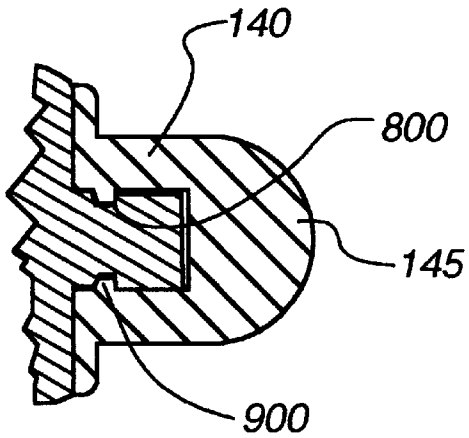
FIG. 8C displays a cross-sectional view of a tip mounted to one embodiment of the present invention.
Figure 8B:
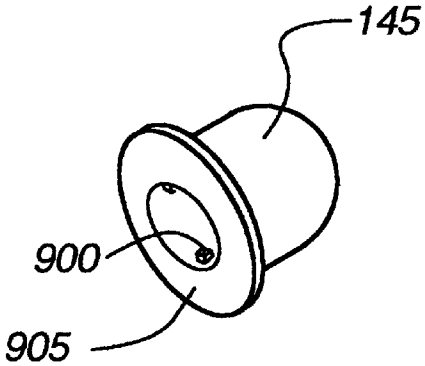
FIG. 8B displays the interior of a tip having a post configuration.

In the present embodiment, the connection means 140 takes the form of a bayonet connection system, also referred to as a post and channel arrangement. As shown in FIG. 8, the end 140 of the head 135 includes a connection means, shown as a pair of grooves 800 or channels (one for each post), each extending at least partially around the circumference of the end. The end is typically made from a material such as plastic, metal, or the like. In the present embodiment, the width of this groove is approximately one-eighth of an inch. A pair of posts 900 of a diameter approximately equal to or slightly greater than the groove's width project into the hollow interior of each tip 145, as shown in FIG. 8B. These posts 900 form the securing mechanism, which permits the tip 145 to mate with the connection means 800 on the end of the head 135.

Generally, the posts 900 fit snugly into the channel 800. The tip 145 is rotated until the posts 900 contact the respective walls defining channel ends 800, thus securing the tip 145 in place. A cross-section of a secured tip 145 is shown in FIG. 8C. The posts 900 and the interior collar from which they extend may be made from a hard rubber. This permits the posts 900 to compress slightly while being forced into the channel 800, and thus exert outward pressure against the channel walls while in place. This outward pressure aids in securing the tip 145 to the end 140. The posts may be slightly flared at their ends to further aid in maintaining contact between the tip 145 and end 140. Similarly, the channels 800 may widen towards the interior of the end of the head 135 in order to more snugly receive the posts. Alternate embodiments may use different materials to manufacture the posts 900, collar 905, or end 140. Further, alternate embodiments may reverse the structure of the post 900 and channel 800, placing the channel within the tip 145 interior and having the post extend perpendicularly from the end. Further, other embodiments may attach a tip 145 to the connectable end 140 by a threaded, screw-type arrangement, by a detent, snap-fit arrangement, by a plug-fit or press-fit arrangement, or by any other means that allow the tip 145 to properly operate and still be easily removed. Any connection means 800 securing a tip 145 to the end 140 tightly enough that the vibrations of the J-shaped vibrating massager 100 do not cause the tip to work free may be employed.

Figure 8A:
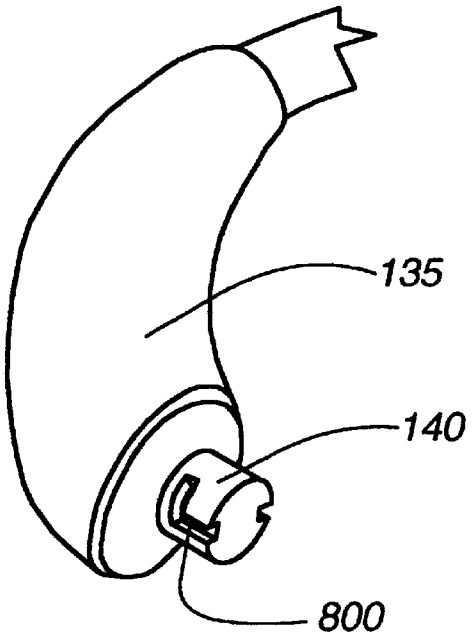
FIG. 8A displays a side view of the end of the J-shaped vibrating massager, specifically showing a channel therein.
Figure 9C:
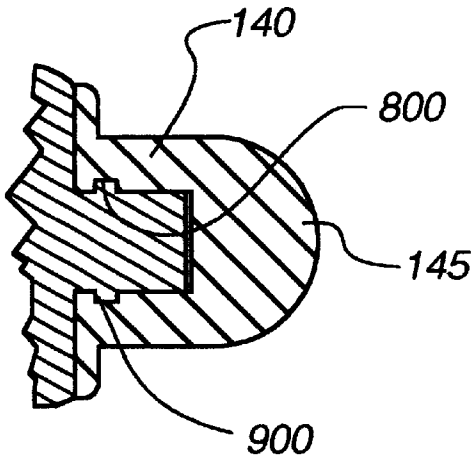
FIG. 9C displays a cross-sectional view of a tip mounted to another embodiment of the present invention.
Figure 9B:
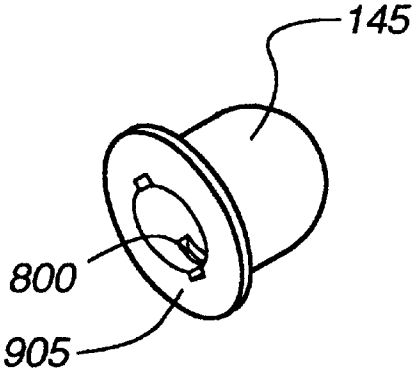
FIG. 9B displays the interior of a tip having a channel configuration.
Figure 9A:
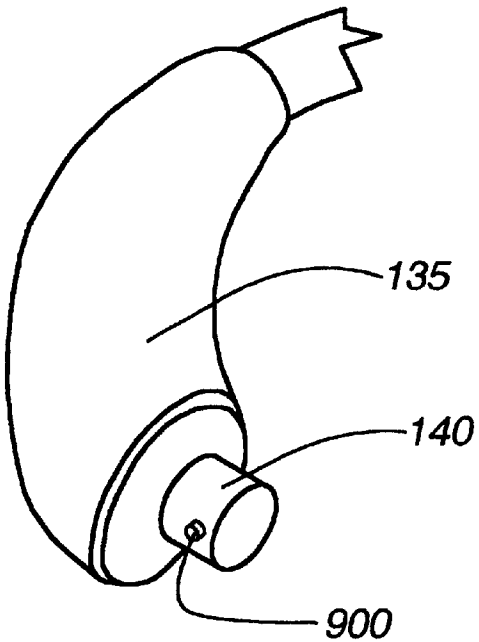
FIG. 9A displays a side view of the end of the J-shaped vibrating massager, specifically showing a post extending therefrom.

The bayonet structure shown in FIGS. 8A, 8B, and 8C may be reversed, so that the channel 800 is located in the interior of the tip 145, while the post extends outward from the connectable end 140. This embodiment is shown in FIGS. 9A–C.

Although the tips 145 have heretofore been described as removably attached to the end 140, intermediate nub 146, and tip holding structure 160, it should be noted that alternate embodiments may include a tip permanently affixed to one or more of these structures. Accordingly, the present invention contemplates fixed as well as removable tips 145.

Further, an alternate embodiment may include an adjustable, or "arc," end that may be positioned at any point along the curve of the J-hook 110. The arc end may slide or otherwise move along the length of the J-hook 110 as desired by the user, and may also be positioned along either the inner or outer curvature of the hook. Once the arc end is suitably located, it may be clamped to the hook, locked, or otherwise secured in place.

When secured, the vibrations induced by the J-shaped massager's 100 vibratory means 500 will cause the arc end to rapidly oscillate, but will not dislodge, slide, or otherwise move the arc end along the length of the J-hook 110. When a tip 145 is attached to the arc end, the oscillations cause a massage in a person with which the arc end is in contact. As with the end 140, intermediate nub 146, and tip holding structure 160, the arc end may either accept a removable tip 145 or may include a permanently affixed or integral tip.

Operation of the J-Shaped Vibrating Massager

In order to operate the present embodiment of the J-shaped vibrating massager 100, a user generally firmly grasps one or both of the handles with his hands in front of his body. The user then angles the barrel 115 and J-hook 110 of the massager 100 such that the head 135 is located adjacent to the body surface the user wishes to massage. Given the design of the present embodiment, including the overall length of the barrel 115 and J-hook 110, a user may easily reach his back with the head 135 while keeping his hands in front of his body. Once positioned (or prior to positioning), the user activates the control means 150, which in turn triggers the vibratory means 500. The stubs 130, intermediate nub 146, and the tip holding structure 160 may also be used to massage various parts of the body. Massage forces may be generated in these locations, as shown in FIG. 1. Further, removable tips 145 may be removably attached at a variety of places along the length of the J-shaped massager simply by providing bayonet attachments where desired.

The vibratory means 500 induces vibrations in the head 135 of the present embodiment. By pressing the head 135 of the J-shaped vibrating massager 100 firmly against his back, the user may easily and conveniently transmit the vibrations of the head 135 to his back in the form of a soothing massage. The characteristics of the massage may vary depending on the tip 145 attached to the connectable end 135 and the speed setting of the vibratory means 500, as well as the pressure applied by the user. In this manner, a user may massage substantially any surface of his body with the J-shaped vibrating massager 100 without twisting, torqueing, or otherwise contorting himself.

Removable Tips

Figure 10A:
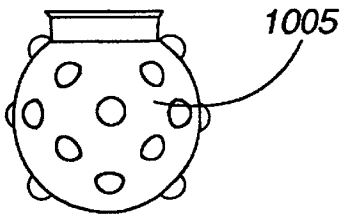
FIGS. 10A–10Y display various tips and tip covers suitable for use with an embodiment of the present invention.
Figure 10B:
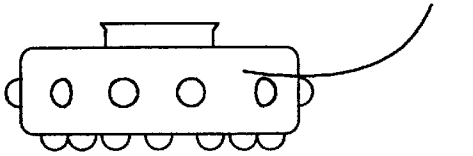
Figure 10C:
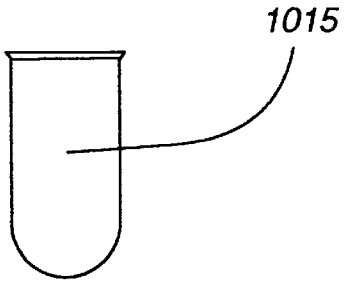
Figure 10D:
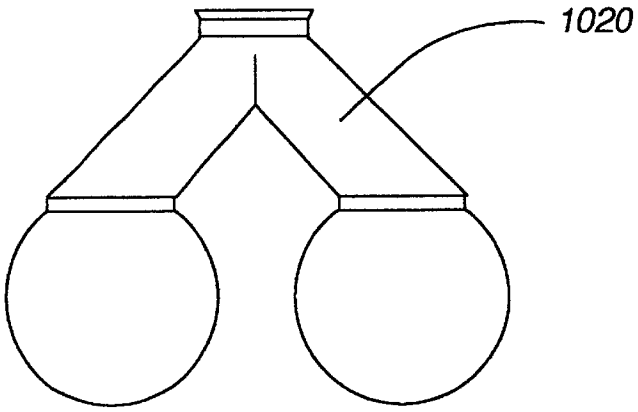
Figure 10E:
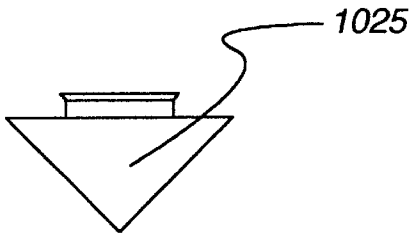
Figure 10H:
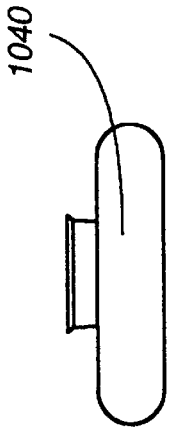
Figure 10G:
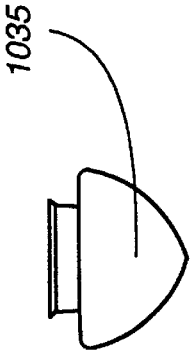
Figure 10F:
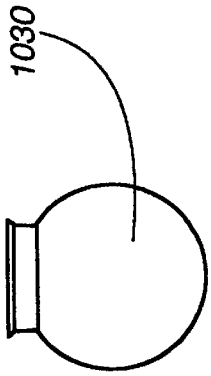
Figure 10K:
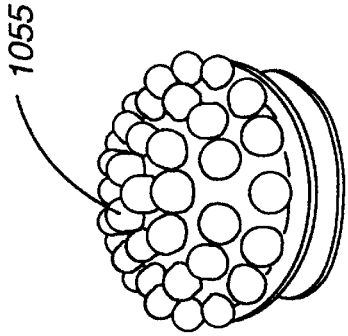
Figure 10J:
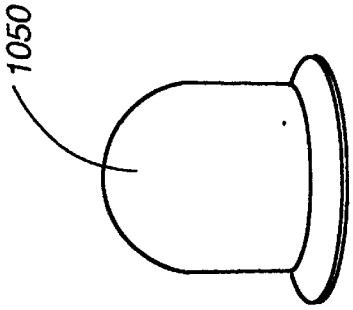

In the present embodiment, any of the tips 145 suitable for use with the embodiment may be attached and removed at will. FIGS. 10A–10Y illustrate different attachment portions adapted to be removably affixed to the head 135 via the connectable end 140. As previously mentioned, a second tip 145 may be removably affixed to the tip holding structure 160 located at the end of the first handle 120. As also previously mentioned, the tip holding structure 160 generally takes the form of a bayonet or post 900 and channel 800 arrangement, similar to that described in the section entitled "Massager Head and Removable Tip Structure." Alternate embodiments may have a single fixed tip 145, rather than permitting a user to change tips as desired.

In FIG. 10A, a round or globe shaped tip 1005 having a smaller stubs protruding from the surface is disclosed. FIG. 10B discloses a disc-shaped tip 1010 that includes smaller stubs protruding from the surface. In FIG. 10C, a pointer or finger-shaped tip 1015 is disclosed. As illustrated in FIG. 10D, multiple tip portions may be grouped together to form a single tip 1020. In FIG. 10E, a substantially triangular-shaped removable tip 1025 is included. The end in FIG. 10D may also include a rounded stub protruding from the center with a ring of indentations circling the stub. In FIG. 10F, a plain, rounded, bulbous tip 1030 is illustrated. In FIG. 10G, a conical, top-like tip 1035 is illustrated. In 10H, a mushroom-cap shaped tip 1040 is illustrated.

Figure 10I:
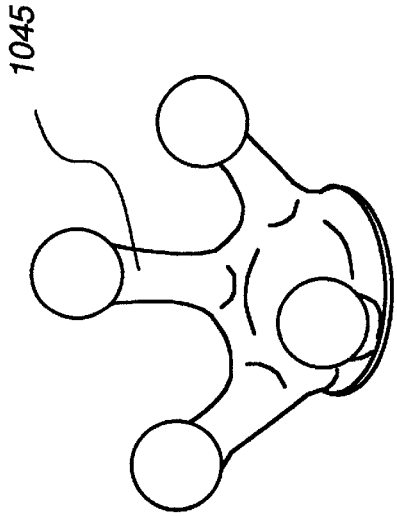
Figure 10N:
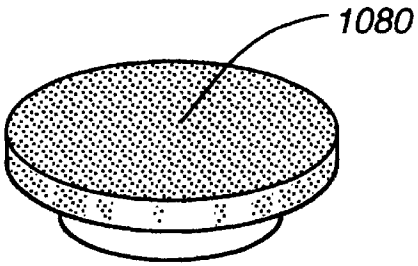
Figure 10M:
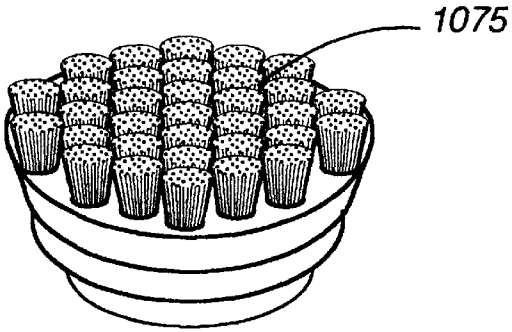
Figure 10L:
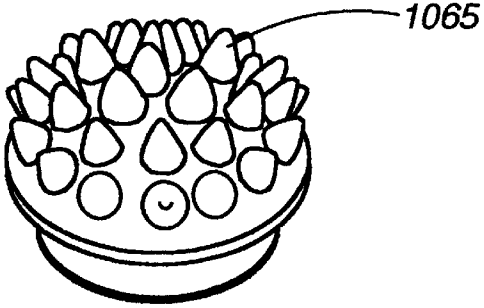
Figure 10Q:
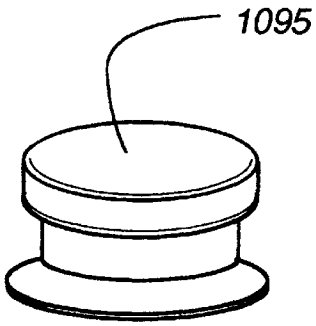
Figure 10P:
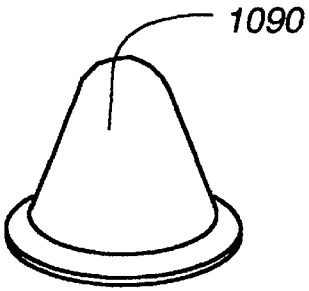

FIG. 10I shows a multi-prong tip 1045 suitable for applying the vibrations of the J-shaped massager 100 to discrete portions of a wide area simultaneously. Although four prongs terminating in spheres are shown, the present embodiment may accept a tip having more or less prongs, or prongs terminating in a different shaped, such as a flat circle, an ellipse, and so forth. FIG. 10J displays a substantially spherical tip 1050 with a metallic finish. Different metallic finishes may be used with the tip 1050, such as silver, brushed steel, gold, bronze, and so forth. Alternately, the tip may be made entirely of metal rather than simply having a metal finish.

FIG. 10K displays a rounded concentrator tip 1055. This tip has a plurality of small spherical surfaces designed to concentrate the motion of the J-shaped vibrating massager 100. Unlike the multi-prong tip of FIG. 10I, the spherical concentrators of the present tip 1055 are affixed directly to the tip base, rather than being located on the ends of prongs. Further, the concentrators may be either firm to the touch, or more yielding. The soft, yielding concentrator tip 1060 may be formed by overmolding the tip. "Overmolding" refers to a process in which an elastomeric material is injected onto a tip 145 after the hard plastic tip shell is produced. FIG. 10L displays a pair of tips 1065, 1070 similar to those of FIG. 10K, except that the concentrators are pointed rather than rounded.

Some tips 145 may be used to apply lotions, oils, powders, and so forth to skin. FIG. 10M illustrates a brush tip 1075 suitable for this purpose. Oils or lotions may be applied to the bristles and worked into the skin via the vibrating motion of the massager 100. Alternately, the sponge tip 1080 of FIG. 10N may permit a user to absorb a greater quantity of these liquids. The greater capacity and surface area of the sponge tip 1080 may allow application across more surface area than the brush tip 1070 of FIG. 10M.

Figure 10O:
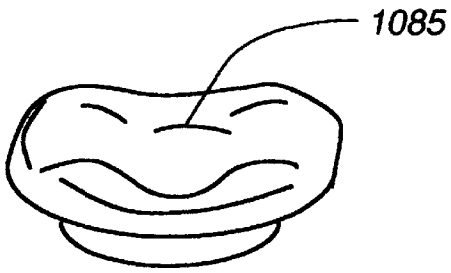
Figure 10X:
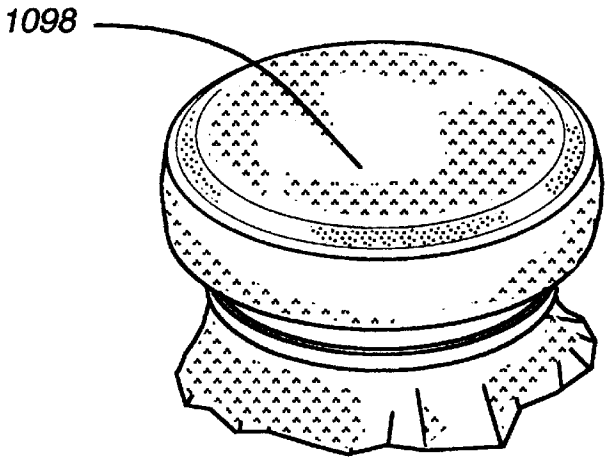

FIG. 10O displays an elliptical tip 1085 having two narrow, concentrated surfaces and two broad, dispersed surfaces. The concentrated surfaces focus vibrations, while the dispersed surfaces spread vibratory movement across a greater area.

FIG. 10P shows a frustoconical tip 1090 suitable for use with the present embodiment, while FIG. 10Q displays a magnetic tip 1095. The magnetic tip 1095 may contain one or more magnets, thus permitting a user of the present invention to indulge in magnetic therapy via the J-shaped vibrating massager 100. Although the magnetic tip 1095 shown is substantially flat, the magnets may be combined with any of the other tips illustrated herein. The magnet may be a standard permanent magnet, or may be an electromagnet.

FIG. 10R shows another example of a pointed tip 1091. This tip, however, has multiple points evenly spaced across the tip surface. This permits the vibratory pressure generated by the vibration means to be evenly dispersed.

FIG. 10S shows another example of a sponge tip 1092, similar to that shown in FIG. 10N, for applying lotions, oils, and other liquids during massage. The tip 1092 shown in FIG. 10S is oval, rather than round.

FIG. 10T depicts a softened variant of the standard tip 1093 shown in FIG. 10F. This tip, like the tip 1030 of FIG.

10F, is a rounded tip. However, the tip 1093 of FIG. 10T is molded from a softer material, such as rubber, or may have a rubber or soft plastic coating overlying a hardened core. This provides a softer feel for the tip when pressed against a user's skin during a massage.

FIG. 10U displays two roller tips, namely a single roller tip 1094 and a double roller tip 1095. The single roller tip 1094 is formed of a ball or sphere connected via an axle to a housing. A user may thus roll the tip back and forth during a massage, rather than dragging the tip. Similarly, the double roller tip 1095 has two rotatable wheels. Generally, the space between the wheels is roughly one inch (or the width of a human spine), thereby permitting a user to simultaneously massage both sides of a spine. However, alternate embodiments may vary this width. The wheels or spheres may be affixed to the tip 1094, 1095 housing by any means known to those skilled in the art. For example, rather than the axle depicted, the single roller tip 1094 may mount the ball on a perpendicular post.

Many of the tips 145 shown in FIGS. 10A–U may be combined with a variety of covers. For example, FIG. 10V shows a tip cover 1096 having a soft, fur-like surface. The tip cover 1096 may be made from felt, velvet, velour, or any other suitable material. In the present embodiment, the tip cover is placed over any of the tips 145 and secured via an integral elastic band. However, alternate embodiments may use different methods to secure the cover, such as Velcro tabs, a separate elastic band, a zipper, and so forth.

Figure 10W:
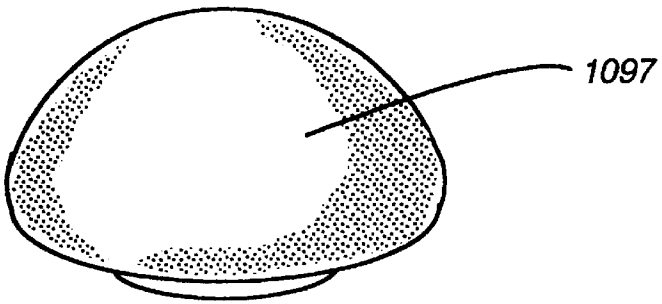
Figure 10Y:
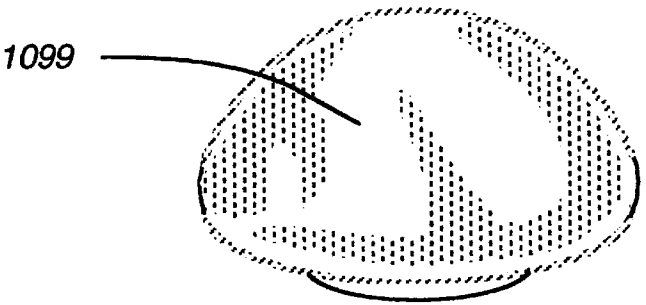

FIG. 10W shows a heatable tip cover 1097. The heatable tip cover 1097 may contain a gel, powder, rice, grain seeds, or other malleable material capable of being heated. Once heated, the tip cover may be placed over a tip 145 and secured via any of the methods described with respect to FIG. 10V. By using the heatable tip cover 1097, a user may give or receive a massage with the added benefit of heat. In the present embodiment, the heatable tip cover contains a material such as ELASTO-GEL, manufactured by Southwest Technologies, Inc. of North Kansas City, Mont. Generally, the heatable tip cover 1097 is waterproof in order to contain the gel and eliminate seepage. Alternately, a tip 145 may include a gel layer placed over the hard tip itself and contained via an integral fabric covering, thus permitting the tip to be heated without requiring a cover.

FIG. 10X displays a sponge tip cover 1098. The sponge tip cover may accept lotions, oils, or liquids in a manner similar to that of the tips 145 illustrated in FIGS. 10M–N. The sponge tip cover 1098 may be secured to a tip 145 as described above.

Finally, FIG. 10W displays a softened tip cover 1099. The softened tip cover 1099 may mute the impact or feeling of any tip 145 over which it is placed, generally giving a gentler massage when used with the present invention.

Any of the embodiments illustrated in FIGS. 10A–10Y may be grouped in combination with multiples of the same attachment or different attachments. In any of the attachment embodiments, the surfaces may be smooth or texturized. In addition to the small stubs illustrated in, for example, FIGS. 10A and 10B, other means of texturizing the surface could be utilized such as ribbed, grooved, or pitted surfaces. In addition to texturized surfaces, the attachment portions, handle portions, and stub portions may be constructed of padded or soft materials. Virtually any shape can be used on the end of the massager 100 providing it can effectively transfer the vibrations from the vibratory means 500 to a user in relative comfort.

In other embodiments of the present invention, a heating element may be added to an individual tip 145 or to the massager 100 itself to cause one or more tips 145 or ends of the device to become heated. In alternate embodiments, the J-hook 110, barrel 115, or entire J-shaped vibrating massager 100 may be heated. The heating means may take the form of an infra-red heater, electric resistance heater, LED, chemical reaction, butane powered heater, hot liquid or solid reservoir, or other heating means in known to those skilled in the art. Alternately, the entire J-shaped massager 100 or J-hook 110 may be heated. Further, the tip 145 may be cooled via a water reservoir, may include a socket or holder for ice or another chilled material such as dry ice, or may be manufactured from a material that cools quickly in cold temperatures.

Of course, many different types of tips 145 may be used other than those described above. For example, tips 145 designed to produce a specific sound may be used with the present invention, as may "aromatherapy" tips 145 having various scents. Other tips may include a built-in reservoir for lotions, oil, or liquids, along with a dispensing mechanism. Tips 145 may include means for inducing or enhancing air movement, including means to heat or cool moving air. Another tip may be able to achieve varying degrees of stiffness or hardness, perhaps via a variable durometer with multiple settings. Yet another alternate tip 145 might take the form of a brush or scrubber suitable for washing or cleaning skin. A tip may be generally luminous, or may glow only in the dark. A tip 145 may be able to expand and contract like a balloon, taking the form of a selectively fillable bladder. A tip may be rotatable across an arc or around a central axis. A tip 145 may further be coated with an antimicrobial material, such as ionic silver or a biocide.

Tips 145 may be powered to provide additional tip motion beyond that supplied by the vibratory means 500. For example, a tip may be spring-loaded to exert a substantially constant force or may be motor driven via a cam or planetary gear. Further, such tips 145 may include internal gears to permit speed adjustment. A tip may also provide electrical stimulation in addition to or instead of mechanical stimulation.

Some tips 145 may be partially or entirely disposable. For example, a tip may have multiple layers of disposable covers, thus permitting a user to discard the outermost cover when it becomes dirty or soiled. Another example is a completely disposable tip having a pre-applied lotion, or one pre-moistened with a substance. Once the tip 145 is used, it may be discarded in favor of another moistened tip.

Any or all of the tips 145 described above may be made from a variety of materials. In the present embodiment, a tip is generally made from a plastic or polymer. However, tips may also be manufactured from metals, such as copper, steel, nickel, and so forth, or stone, including pumice and granite.

Motor and Vibratory Structure

Generally, the massaging action of the present invention is accomplished via a vibratory means 500. In the present embodiment, the vibratory means 500 takes the form of an eccentric motor and attached off-center weight 1100 (also colloquially known as a "counterweight") housed within the head 135. The motor quickly turns the off-center weight in a circle, thus creating rapid vibrations. Of course, the vibration speed varies directly with the revolutions per minute (rpm) of the motor. The vibrations may be oscillating, linear reciprocating, or orbital in nature depending on the type of motor and actuation means used. In alternate embodiments, the vibratory means 500 may be a piezoelectric device capable of inducing high-frequency vibrations, or may be a combination of motors capable of inducing high and low frequency vibrations.

The present invention may also be used with the vibratory means turned off or in an alternate configuration. Further, the J-shaped massager 100 may be constructed without a motor, thus relying on manual application of force to create a massaging effect.

Returning briefly to FIG. 5, it may be seen that the eccentric motor is typically affixed to the bottom housing 520 of the head 135, such as by a strapping mechanism 525 or other fixation structure. Alternate embodiments may locate the motor or other vibratory means 500 in different portions of the J-shaped massager 100. For example, an alternate embodiment may attach the motor directly to the J-hook 110.

With further reference to FIG. 5, the motor 500 is attached to the control means 150 by a motor or power cord. The control means 150 is also connected to a power cord 155 that plugs into a home power source. When the power cord 155 is plugged into a home power source and the control means 150 activated, the motor 500 turns on and vibrates the head 135 of the J-shaped vibrating massager 100. The motor generally causes an eccentric or off-balance weight 1100 to rotate around the shaft of the motor. The eccentric weight causes the motor shaft to vibrate, thereby causing anything attached with the motor 500 (i.e., the J-shaped rod) to vibrate also.

In the present embodiment, the eccentric motor 500 is manufactured by Mabuchi Motor Co., Ltd. of Japan, although alternate embodiments may employ different motors. The eccentric motor 500 may be either alternating current (A/C) or direct current (D/C) powered. Still with respect to the present embodiment, the motor revolves approximately 2,200 to 2,400 times per minute, with a variable speed range of about +/−200 rpm. In a variable speed configuration, the motor speed may be adjustable via a control means 150. Because the rod is rigid the vibrations caused from the eccentric motor 500 may cause not only the end of the J-hook 110 portion of the J-shaped rod 105 to vibrate, but also induce vibrations along the length of the J-hook 110. The vibrations along the length of the J-hook 110 may be dampened closer to the barrel 115, depending on the construction of the hook and barrel.

Further, vibrations induced in the head 135 or other portions of the present invention may be damped in order to prevent additional portions of the J-shaped massager 100 from vibrating. For example, vibrations may be isolated in the head 135 via a dampened joint located between the head 135 and the J-hook 110.

Alternate embodiments may include additional massaging surfaces along the J-hook 110 in order to make use of such vibrations. For example, the stubs 130 shown in FIG. 6 may be used as massage surfaces and are located approximately in the middle of the J-hook 110. In still other embodiments, the J-hook 110 may be sufficiently rigid or packed with a dampening material in order to negate or minimize vibrations along the length of the hook.

In the present embodiment, the eccentric motor 500 has a variable speed. The motor may rotate at two or more different speeds. Speed selection is generally performed by selecting from among a "low," "high," or "off" position via the control means 150. As the control means 150 changes settings, the motor speed is adjusted accordingly. Alternate embodiments may employ a single speed motor 500, or may have even more speed settings. Further, the variable speed range may be lesser or greater in alternate embodiments.

When used, the user presses the vibratory end of the massager 100 (that is, the head 135, end 140, and tip 145) on the area of their body requiring massage. In yet further embodiments, it is contemplated that the vibratory means 500 may be removable from the main body of the device and may include battery powered means or rechargeable means powering the vibratory means 500. Whether the vibratory means 500 is removable or fixed with the main body, it is contemplated that a cordless embodiment of the present invention may be developed using rechargeable power sources.

Figure 12:
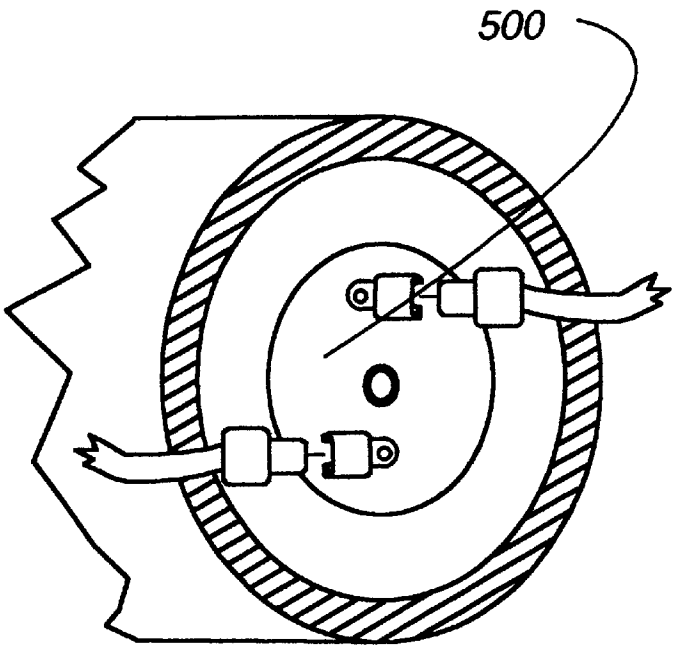
FIG. 12 displays an enlarged view of the back surface of the eccentric motor vibratory means in accordance with an embodiment of the present invention.
Figure 11:
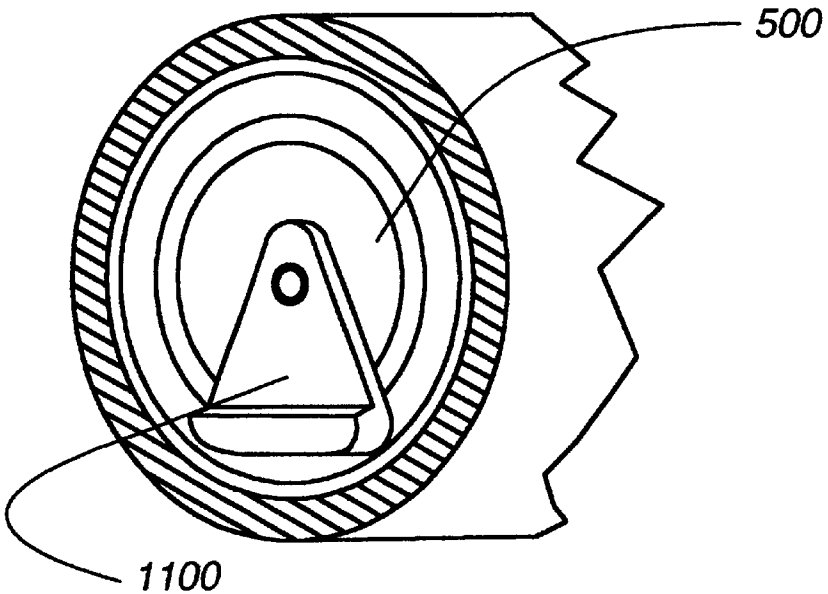
FIG. 11 displays an enlarged view of the front surface of an eccentric motor vibratory means in accordance with an embodiment of the present invention.

FIGS. 11–12 provide enlarged views of the front and back surfaces of the eccentric motor vibratory means 500 included in the embodiment illustrated in FIG. 1. As illustrated in FIG. 11, an off-balance weight 1100 is rotated around the shaft of the motor to produce vibrations. The vibrations are transferred down to the end of the curved portion of the J-shaped rod 105. In this embodiment, a simple electrical cord 155 is connected with power connections on the back of the motor to provide power to the motor. In addition, the present invention may include or make use of vibratory means 500 other than an eccentric motor.

Figure 13:
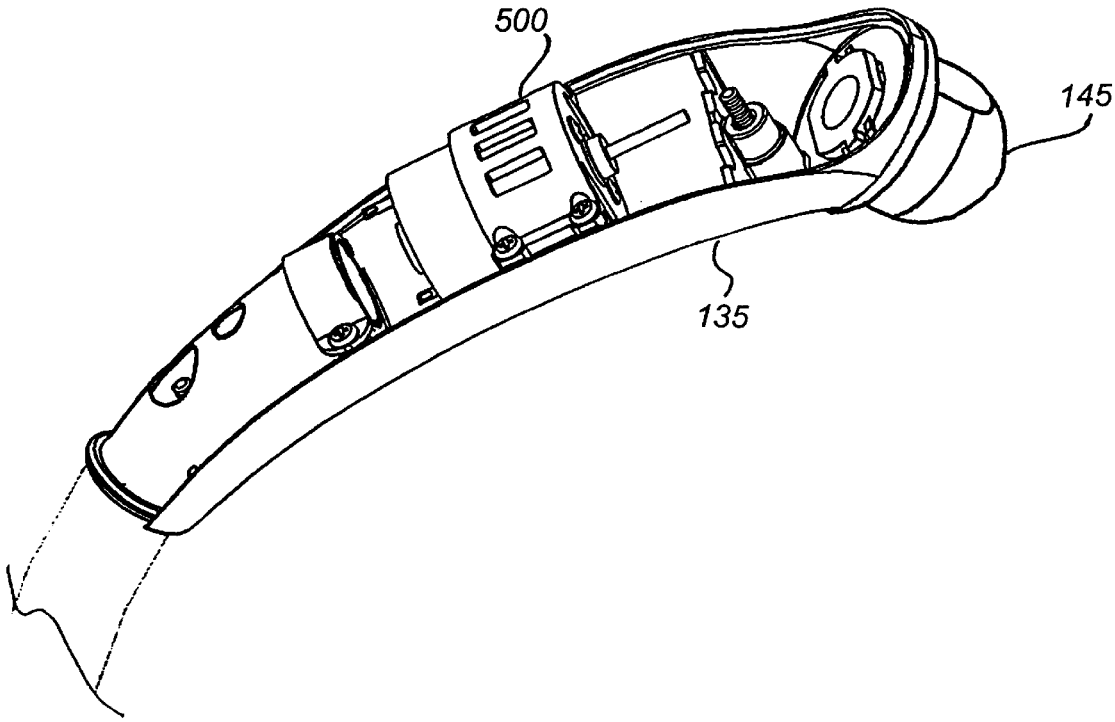
FIG. 13 displays an isometric view of the vibratory means mounted within the head of the J-shaped massager.

FIG. 13 shows the vibratory means 500 mounted within the head 135 cavity. As can be seen, in the embodiment shown in FIG. 13 the vibratory means 500 is affixed to the head 135 via screws. Alternate embodiments may use different affixing means, such as straps or adhesive.

The location of the vibratory means 500 on the rod 105 affects the degree of vibration of the rod. For example, it the vibratory means 500 are placed near one free end of the present embodiment, the vibration of that free end will be maximized. In addition, in an embodiment using an eccentric motor as the vibratory means 500, the direction of vibration of the rod 105 end adjacent the eccentric motor can be manipulated depending on the location of the rod with respect to the axis of rotation of the motor shaft. For example, if the motor is configured such that the rod 105 and the motor shaft are concentric (i.e., the eccentric weight rotates around the rod), the adjacent free end of the rod will be caused to rotate in a circular or orbital motion (i.e., mimicking the path of the eccentric weight). Alternatively, if the motor shaft and rod are not concentric, the vibration of the eccentric motor 500 will cause the free end of the rod to vibrate in a more linear motion. This quasi-linear motion may be either a side to side or up and down motion, depending on the placement of the motor.

The alignment of the axes of the eccentric motor 500 and rod may also affect the vibration of the rod. For example, when the axis of the eccentric motor's axle is aligned with the rod's axis, the rod will vibrate is a substantially up-and-down manner. Conversely, where the axis of the eccentric motor's axle is transverse to the rod 105 axis, a side-to-side vibration is induced.

Alternate embodiments may incorporate vibratory means 500 capable of being repositioned at different locations along the rod in order to vibrate different portions of the J-shaped massager 100. In such embodiments, a releasable clamping structure may be used to release and re-clamp the vibratory means 500 to the rod for selective repositioning. Further, multiple movable vibrator means could be connected with the rod 105 along various points of the rod. In various embodiments, both single speed and variable speed motors may comprise the vibratory means 500. Variable speed motors may allow a user to adjust the level of vibration generated by the motor.

Further, alternate embodiments may use vibratory means 500 other than those disclosed above, or may include additional features for the vibratory means. For example, the vibratory means 500 may consist of a hand or foot pump unit, or may be pneumatic or hydraulic. Alternate embodiments may employ a combustion motor or may use water pressure from a water line (such as a shower head) to provide vibration. Hydraulic pressure, for example, may drive a gear located in the head 135 in order to induce vibration. The vibration means may consist of a wind-up spring, or be magnetically driven. Further, the motion of the vibratory means 500 may be amplified via a spring member placed in the J-hook 110 or head 135.

Many vibratory means 500 suitable for use with the present invention may use a different type of off-center weight 1100 than previously mentioned, or may employ no off-center weight at all. For example, one embodiment may place the off-center weight in the head 135, but house the motor 500 in the J-hook 110, barrel 115, or a handle 120, 125. In this embodiment, the motor is attached to (and turns) the off-center weight 1100 via a flexible driven cable connecting the two. Other embodiments may drive the off-center weight 1100 via a solenoid. Yet other embodiments may use a percussion or cam-driven motor, and thus eliminate any need for a counterweight. In the case of a cam-driven apparatus, the cams may either move up and down or rotate. Further, the counterweight 1100 may take the form of a spring that is continuously compressed and released by the motor, rather than a rotated weight.

The motor 500 may also have a programmable cycle permitting vibrations to continuously vary according to either a set or user-defined cycle. The programmable cycle may take the form of a hardwired controller capable of attaining different settings, a programmable memory, or software containing commands which, when executed, cause the vibratory means 500 to vary.

Although the present embodiment is powered via a home power supply, alternate embodiments may use different power sources. For example, an alternate embodiment may run on battery power and thus be cordless. Such batteries may be either rechargeable or nonrechargeble. Further, an alternate embodiment powered via a battery may also include a power indicator on the surface of the J-shaped vibrating massager 100 indicating the remaining battery life. Where such an embodiment is rechargeable, the batteries may be recharged either from a home power supply or an alternate power supply, such as a twelve volt car battery connected to with a cigarette lighter adaptor.

Alternate Embodiments

The present invention may have many alternate embodiments. Several of these are described here. However, the following descriptions should by no means be considered a complete recitation of all possible variants. Rather, these alternate embodiments are given by way of example rather than limitation.

Alternate embodiments may include multiple massage surfaces in addition to the head 135 and tip 145 structure described above. The example of one or more stubs 130 capable of providing massage has already been discussed with respect to FIG. 6. These stubs may be located at any point along the J-hook 110 or barrel 115, or may even be mounted on a handle 120, 125.

Figure 14A:
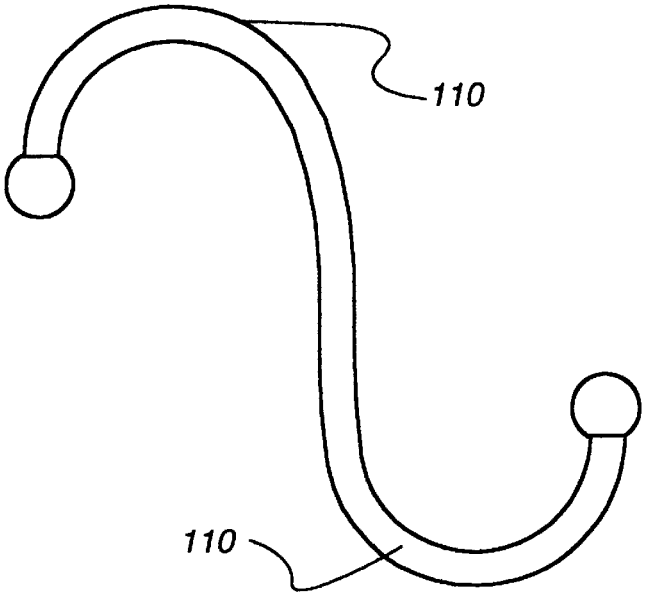
FIGS. 14A–14D display additional embodiments in accordance with the present invention.
Figure 14B:
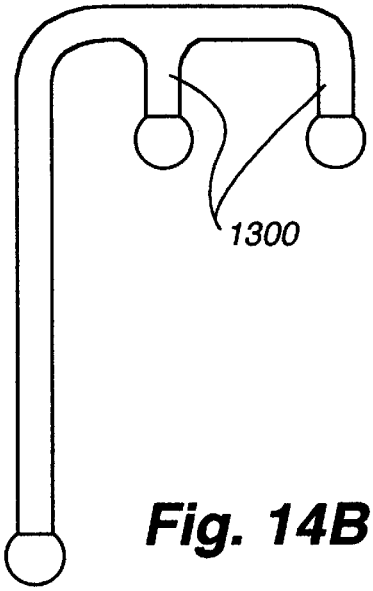
Figure 14C:
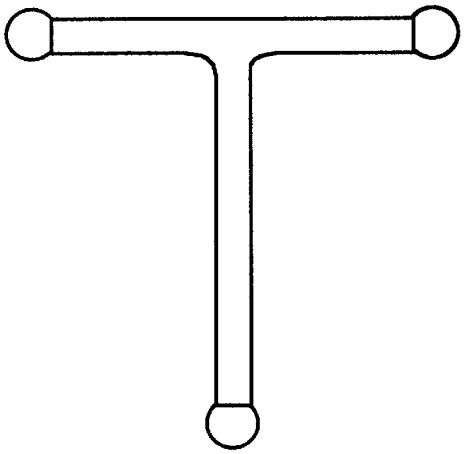

Other shapes are also contemplated by the present invention. FIGS. 14A–14D illustrate additional configurations of the present invention. In FIG. 14A, a double-hooked J-shaped configuration is illustrated. In such a design, it is possible that the ends of both J-hook 110 portions may vibrate. In FIG. 14B, multiple end portions 1300 extend from the J-hook portion of the rod 105. In other embodiments, three portions or more may extend from the J-hook 110. In FIG. 14C, the rod is T-shaped. In such a configuration, the ends of both sides of the top of the T-shape, as well as the trunk, may be caused to vibrate. Also, depending on the shape of rod selected one or more vibrator means may be utilized to provide vibration to one or more areas of the rod.

Figure 14D:
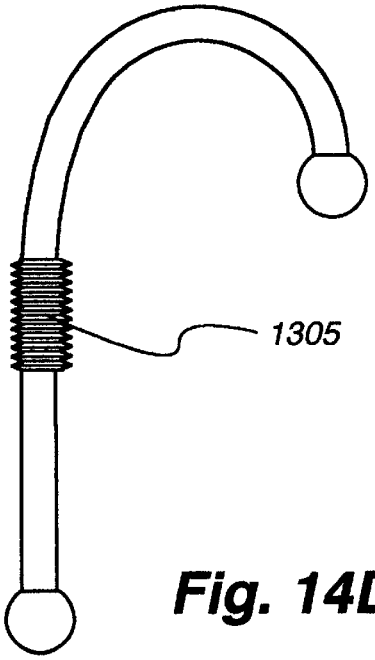

In FIG. 14D, it is contemplated that the rod portion may include a flexible or extendable portion 1305 for changing the configuration of the J-shape. In such a design, the user is able to bend the straight portion of the J-shape to cause the end of the J-hook 110 portion to move towards or away from the straight portion of the J-shape. In one embodiment, the bendable portions of the rod are comprised of locking hinge portions. In another embodiment, the bendable portions of the rod are comprised of either a bendable metal or a plastic ball and socket product as manufactured by Lockwood Products (Loc-Line) or an equivalent.

Alternatively, if extendable means are used, the user may be able to extend the length of the straight 115 or hook 110 portion of the J-shape. In either case, the flexible or extendable portions may be temporarily fixed in place to cause the length of the rod to be rigid. As mentioned above, when the vibratory means 500 are energized, the rod is typically rigid in order to permit the head 135 to rapidly oscillate. Further, where multiple portions of the J-hook 110 or barrel 115 serve as massage surfaces, a rigid structure may aid in transferring vibrations to these additional surfaces. In one embodiment, the extendable means may be comprised of a telescoping rod adapted to lock in place. In another embodiment, the extendable means may be comprised of a series of rod portions that can be connected to achieve a desired length.

Figure 15:
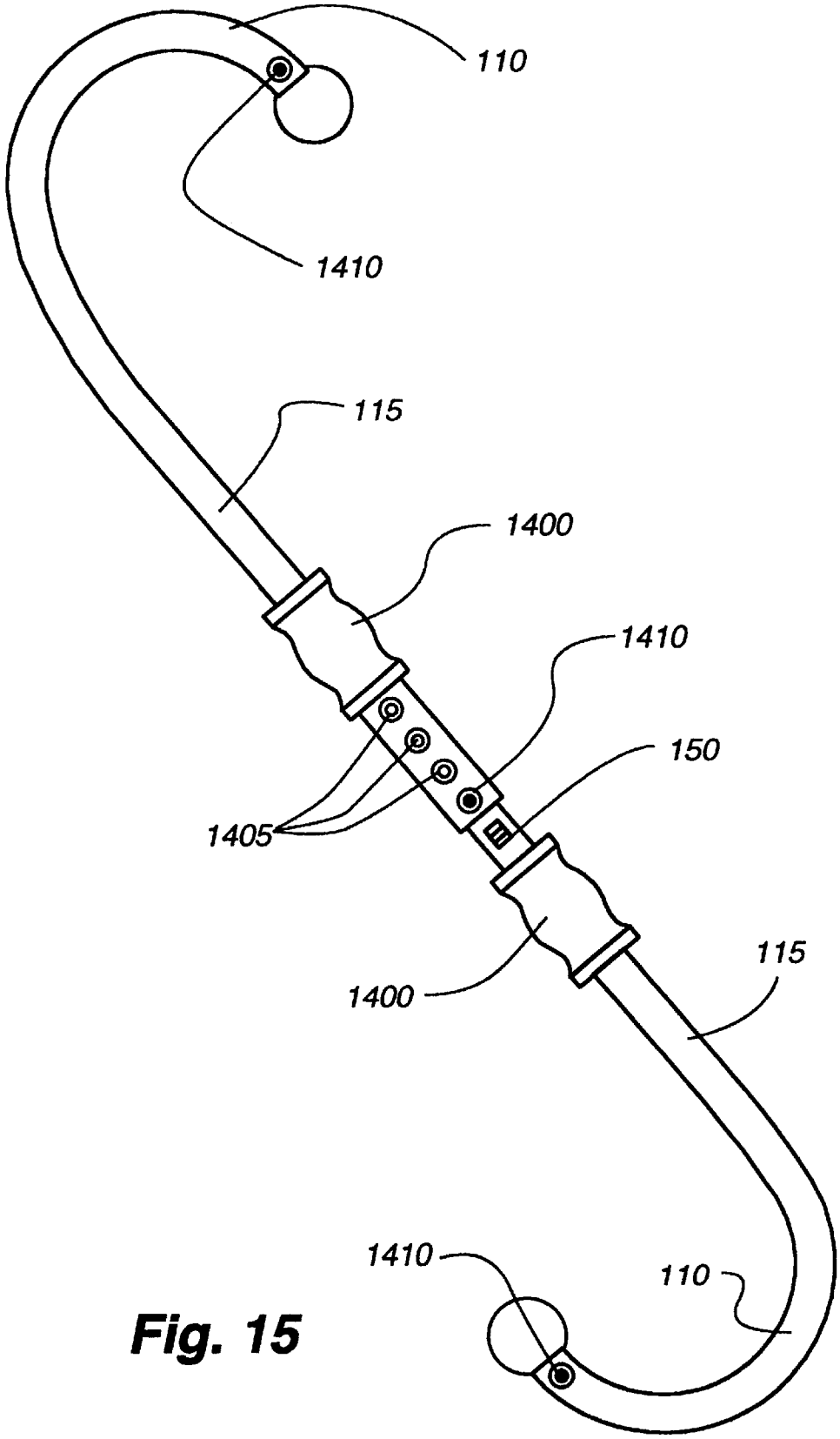
FIG. 15 displays yet another embodiment in accordance with the present invention.

FIG. 15 illustrates another embodiment of the present invention. In FIG. 15, the massager 100 includes two J-hook 110 ends. The J-hook ends are joined by a straight portion. In the center of the straight portion, between the J-hook ends 110, are motor controls 150 to operate any vibrating means included in the device. Padded hand grips 1400 are also included in the center of the straight portion adjacent either side of the motor controls. The ends of each of the J-hooks are round and bulbous and are removable. In one embodiment, one J-hook 110 is adapted to be removably receive the second J-hook. The end of the straight portion extending from the first J-hook 110 is inserted into the end of the straight portion extending from the second J-hook portion.

In the embodiment of FIG. 15, multiple holes 1405 may be drilled along the length of one of the straight portion ends and along the circumference of one of the straight ends. A small button 1410 on the second straight portion end may be received by one of the holes on the first straight end portion when the portions are joined. The small button is generally operatively connected with a push-button located on an exterior 505 portion of the rod 105. The push-button may allow the user to adjust the length and/or the rotation of the J-hook 110 ends with respect to each other by causing the small button to reside in different holes along either the length or the circumference of the straight portion end. The small button 1410 will snap-fit into the selected hole 1405 causing both J-hook 110 portions to lock together.

Figure 16B:
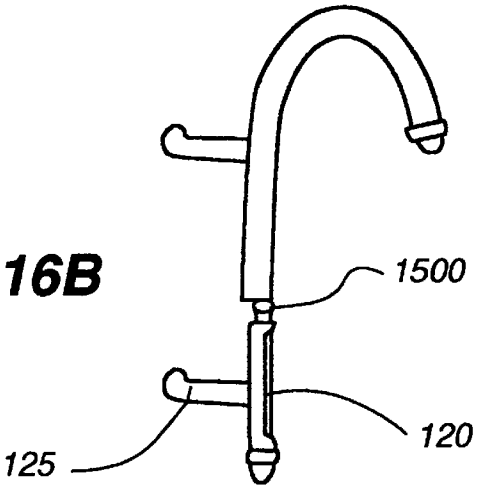
FIGS. 16A–16C display yet another embodiment of the present invention.
Figure 16C:
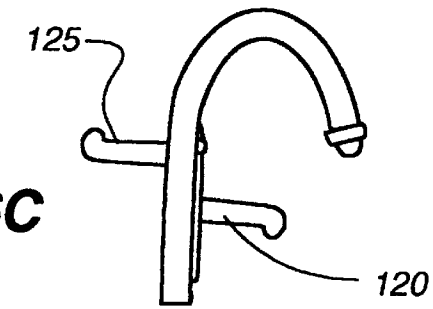
Figure 16A:
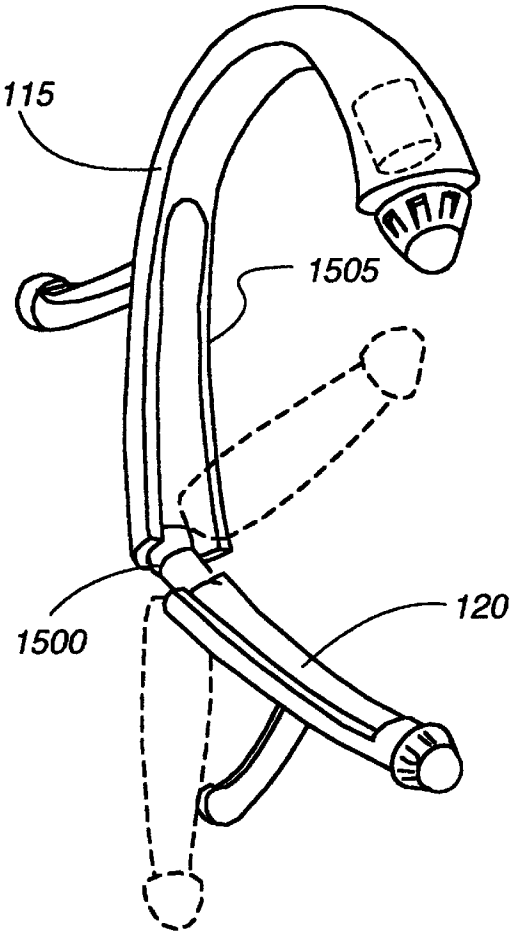

FIGS. 16A–16C illustrate yet another embodiment of the present invention. In addition to including removable tips 145, the massager 100 may also include folding portions 1500. As illustrated, to create a more portable, smaller massager 100, the rod may include a straight portion 1500 that folds toward and is received by a recess 1505 formed in the J-hook 110 portion of the massager 100. In other embodiments, the handles 120, 125 may also be foldable and storable within a portion of the barrel 115. Alternately, other embodiments may omit handles in order to maximize portability. It is envisioned that the folding portions may snap-lock into place when extended for use.

FIGS. 17A–17D illustrate a portable embodiment of the present invention. Instead of a folding straight portion, the massager 100 may include an extendable straight portion 1600 that can be concentrically stored within straight portion of the J-hook 110 end. When in use, the straight portion 1600 can be extended and locked in place. Alternatively, the straight portion can be removed entirely from the J-hook 110 end and both portions (the J-hook 110 end and straight end portions) can be used separately.

Figure 18:
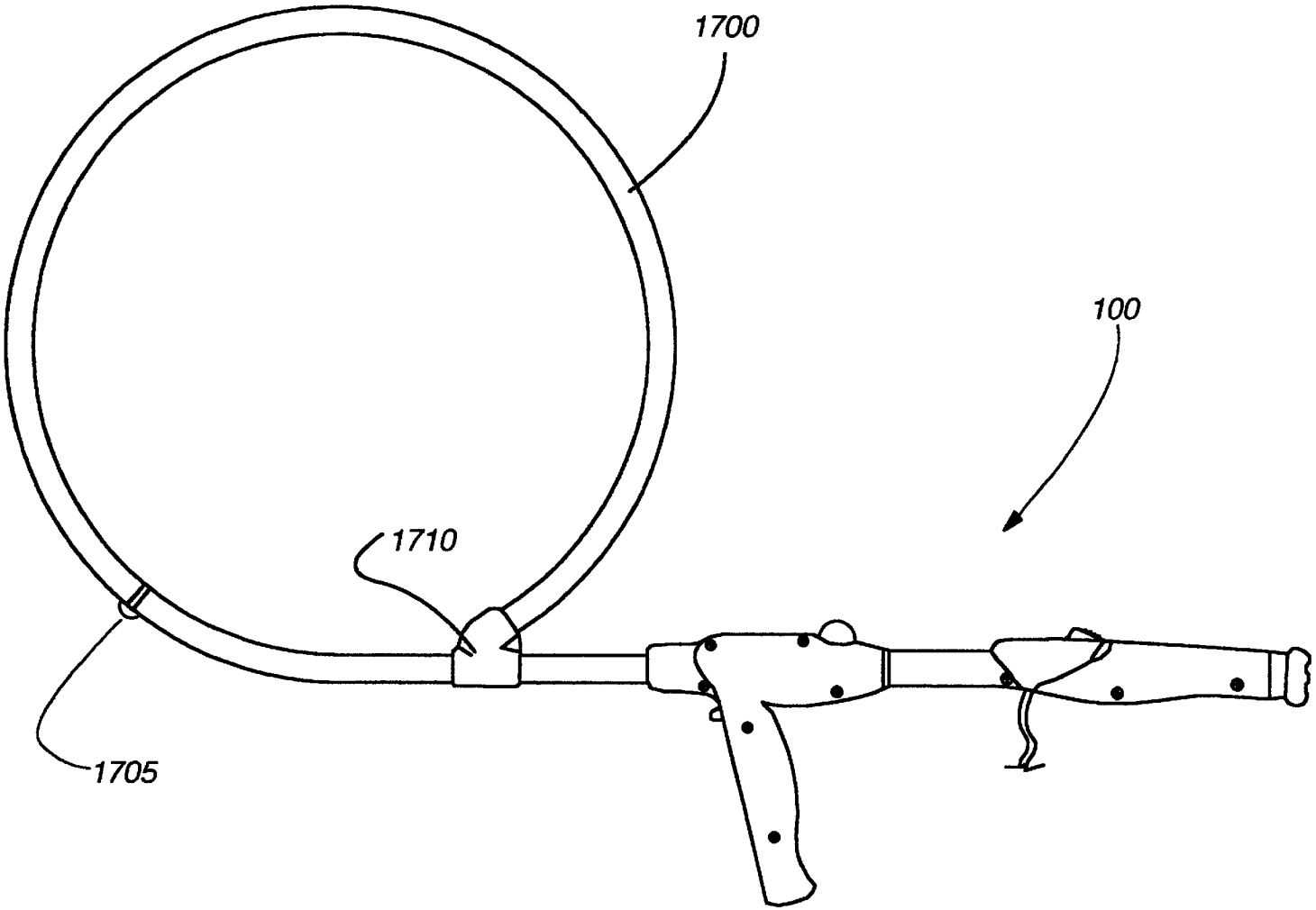
FIG. 18 displays another embodiment of the present invention wherein the J-hook is replaced by a circular massage portion.

FIG. 18 illustrates yet another embodiment of the present invention. In this embodiment, the J-hook 110 is replaced by a circular massage portion 1700. A user may place the circular portion 1700 of the massager 100 about any portion of his body he wishes to massage. When in use, substantially all of the circular massage portion 1700 may vibrate in order to produce a massage effect from multiple angles. Further, this embodiment may be fitted with multiple heads or stubs (not shown) to concentrate the vibrations produced by the vibratory means 500. Additionally, a hinge 1705 may be placed partway along the circular massage portion in order to allow it to open and close as desired. When closed, the circular portion 1700 may be secured by a catch or other locking mechanism 1710. Thus, a user may open the circular massage portion 1700 at the hinge 1705, fit it about his or her torso, and securely close the circular massage portion in order to provide a full-torso massage.

Still further embodiments are possible without departing from the spirit or scope of the invention. For example, the J-hook 110, barrel 115, or both might be flexible to permit a user to configure the massager 100 as necessary. The various measurements given in this specification may be lengthened, reduced, or the shape of certain elements changed. For example, the J-hook 110 may have a larger or smaller radius, may form three sides of a rectangle instead of a circular arc segment, may form two legs of a triangle, may form a section of an ellipse, and so forth. The J-shaped vibrating massager 100 may be mountable on a user's shoulders rather than having one or more handles. The massager 100 may have a timer feature which automatically deactivates the vibratory means 500 after a certain time elapses. The J-hook 110 may include an articulated joint in order to allow a user to vary the angle of the hook. One or both handles may have adjustable lengths or may be rotatable about the handle's long axis or pivotable relative to the length of the axis.

Further, the J-shaped vibrating massager 100 may be personalized via the addition or removal of replaceable panels. These panels may come in a variety of colors and designs, thus permitting a user to change the color and look of the massager 100.

Conclusion

Myriad configurations of the shape of the rod portion are possible in the present invention. Regardless of the rod shape selected, the user may manipulate the massager to bring the vibrating end of the rod into contact with substantially all surfaces of the user's body while grasping the rod with their hands. Particularly, the user may reach around either side or the top of his body to massage all surface areas of their back while grasping the massager with one or both hands located in front of him.

What is claimed is:

1. A personal massager device, comprising:

a head;

a curved hook having a first and second hook end, the first hook end attached to the head;

a barrel having a first and second barrel end, the first barrel end attached to the second hook end;

a handle connected to the barrel and rotatable about a longitudinal axis of the barrel;

electrically powered percussion vibratory means housed within the head;

a control means for controlling the vibratory means, the control means attached to the vibratory means; and a power supply cord connected to the control means, the power supply cord terminating in a plug adapted to connect to a home power supply.

2. A personal massager device, comprising:

a head having a first and second end;

a J-shaped hook having a first and second S-hook end, the first J-book end attached to the second end of the head;

a barrel having a first and second barrel end, the first barrel end attached to the second J-hook end;

a first handle connected to the second barrel end;

a second handle connected to the barrel and rotatable about a longitudinal axis of the barrel; and wherein the overall length of the combination of barrel and S-hook end permits a user to reach his back with the first end of the head while grasping the first handle.

3. The personal massager device of claim 2, further comprising a handle release for controlling the rotation of the second handle, the handle release operatively connected to the second handle.

4. The personal massager device of claim 3, wherein the handle release comprises:

a depressable switch having a top surface;

a spring operatively connected to an upwardly biasing the depressable switch, the spring compressing when the depressable switch is depressed;

a lock connected to the top surface of the depressable switch; and a pivot point operably connected to the depressable switch and about which the depressable switch rotates.

5. The personal massager device of claim 4, wherein:

the barrel further comprises a plurality of indented slots; and the lock is forced into one of the slots by the upwardly biasing action of the spring when the depressable switch is not depressed.

6. The personal massager device of claim 2, further comprising a tip attached to the first end of the head.

7. The personal massager device of claim 6, wherein the tip is removable attached to the second end of the head.

8. A personal massager device, comprising:

ahead having a first and second end;

a curved J-shaped hook having first and second ends, the first end attached to the second end of the head;

a barrel having a first and second end, the first barrel end attached to the second end of said J-hook;

a first handle connected to the second barrel end;

a second handle connected to the barrel and rotatable about a longitudinal axis of the barrel;

vibratory means operatively connected to the head; and wherein the total length of the personal massager device is sufficient to permit a user to touch the head to his back without reaching over his shoulder or around his back.

9. The personal massager device of claim 8, wherein the total length of the personal massager device is adjustable.

10. The personal massager device of claim 8, further comprising:

a control means for controlling to vibratory means, the control means attached td the first handle.

11. The personal massager device of claim 10, wherein the vibratory means; is operatively connected to the head by vibrations induced in the head by the vibratory means.

12. The personal massager device of claim 11, wherein the vibratory means comprises a percussion motor.

13. The personal massager device of claim 11, wherein the vibratory means is located within the interior of the head.

14. The personal massager device of claim 13, farther comprising:

a connection means located on the first end of the head; and a removable tip having an interior sidewall, the removable tip attached to the first end of the head by the connection means.

15. The personal massager device of claim 14, wherein the connection means comprises:

a channel having a width running at least partially about the interior circumference of the sidewall of the tip; and a post having a diameter extending outwardly from the first end of the head, the diameter of the post being approximately equal to the width of the channel.

16. The personal massager device of claim 14, wherein the connection means comprises:

a channel having a width running at least partially about the exterior circumference of the first end of the head; and a post having a diameter extending inwardly from the sidewall of the tip into the interior of the tip, the diameter of the post being approximately equal to the width of the channel.

17. The personal massager device of claim 10, further comprising:

a handle release for controlling the rotation of the second handle and attached to the second handle.

18. The personal massager device of claim 17, wherein the handle release permits the second handle to rotate to a plurality of selectively fixed positions.

19. The personal massager device of claim 17, further comprising at least one stub attached to a portion of the J-shaped massager operably connected to the vibratory means.

20. The personal massager device of claim 19, wherein the vibratory means is contained within the head.

21. The personal massager device of claim 19, wherein the vibratory means is attached to the J-hook.

22. The personal massager device of claim 19, wherein the vibratory means is attached to the barrel.

23. The personal massager device of claim 19, wherein the vibratory means is contained within one of the first handle and second handle.

24. The personal massager device of claim 17, further comprising an are tip adjustably connected to the J-hook and capable of being repositioned along the surface of the J-hook.

25. The personal massager device of claim 24, wherein the arc end may be affixed to any portion of the J-hook.

26. The personal massager device of claim 25, further comprising:

a connection means located on the first end of the head; and a removable tip having an interior sidewall, the removable tip attached to the first end of the head by the connection means.

27. The personal massager device of claim 24, wherein a channel having a width running at least partially about the exterior circumference of the first end of the head; and a post having a diameter extending inwardly from the sidewall of the tip into the interior of the tip, the diameter of the post being approximately equal to the width of the channel.

* * * * *

UNITED STATES PATENT AND TRADEMARK OFFICE

CERTIFICATE OF CORRECTION

PATENT NO. : 6,758,826 B2 
DATED : July 6, 2004
INVENTOR(S) : Harold A. Luettgen and Gary D. Golichowski It is certified that error appears in the above-identified patent and that said Letters Patent is hereby corrected as shown below:

Column 18,
Lines 19 and 27, replace “S-hook” with -- J-hook --.
Line 20, replace “J-book” with -- J-hook --.
Line 54, replace “ahead” with -- a head --.

Column 19,
Line 5, replace “to” with -- the --.
Line 6, replace “td” with -- to --.
Line 8, delete “;”.
Line 14, replace “farther” with -- further --.

Column 20,
Line 19, replace “are” with -- arc --.

Signed and Sealed this

Seventeenth Day of August, 2004

JON W. DUDAS
*Acting Director of the United States Patent and Trademark Office*